US009959843B2

(12) United States Patent
Ohnishi

(10) Patent No.: US 9,959,843 B2
(45) Date of Patent: May 1, 2018

(54) SOUND PRODUCING APPARATUS, KEYBOARD INSTRUMENT, AND SOUND PRODUCTION CONTROL METHOD

(71) Applicant: YAMAHA CORPORATION, Hamamatsu-shi (JP)

(72) Inventor: Kenta Ohnishi, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days. days.

(21) Appl. No.: 15/547,619

(22) PCT Filed: Dec. 18, 2015

(86) PCT No.: PCT/JP2015/085522
§ 371 (c)(1),
(2) Date: Jul. 31, 2017

(87) PCT Pub. No.: WO2016/151963
PCT Pub. Date: Sep. 29, 2016

(65) Prior Publication Data

US 2018/0033407 A1 Feb. 1, 2018

(30) Foreign Application Priority Data

Mar. 25, 2015 (JP) ..... 2015-062684

(51) Int. Cl.
*G10C 1/04* (2006.01)
*G10H 1/32* (2006.01)
(Continued)

(52) U.S. Cl.
CPC ..... *G10C 1/04* (2013.01); *G10C 3/06* (2013.01); *G10C 3/166* (2013.01); *G10C 3/18* (2013.01);
(Continued)

(58) Field of Classification Search
CPC . G10C 1/04; G10C 3/06; G10C 3/166; G10D 3/02
See application file for complete search history.

(56) References Cited

U.S. PATENT DOCUMENTS 1,588,730 A * 6/1926 Hessel ..... G10D 3/02 84/294
1,711,386 A * 4/1929 Hey ..... G10D 3/02 84/294
(Continued)

FOREIGN PATENT DOCUMENTS

JP H02262195 A 10/1990
JP 2013077000 A 4/2013
JP 2014142378 A 8/2014

OTHER PUBLICATIONS

International Search Report issued in Intl. Appln. No. PCT/JP2015/085522 dated Feb. 23, 2016. English translation provided.
(Continued)

*Primary Examiner* — Robert W Horn
(74) *Attorney, Agent, or Firm* — Rossi, Kimms & McDowell LLP

(57) ABSTRACT

A sound producing apparatus includes: a plurality of sound producing members with differing oscillation frequencies; dampers each corresponding to a respective sound producing member and suppressing vibration by contacting the corresponding sound producing members; a damper operation mechanism that moves each damper, thereby controlling a state of contact of the damper with a corresponding sound producing members; a soundboard that undergoes sympathetic resonance with sound producing members; a vibrator that vibrates the soundboard; an acquisition unit configured to acquire an audio signal; a signal output unit configured to: generate a drive signal for driving the vibrator with a vibration corresponding to the acquired audio signal;
(Continued)

and output the drive signal to the vibrator; and a damper control unit configured to drive the damper operation mechanism to change a state of contact between the sound producing members and their corresponding dampers, based on frequency distribution of acquired audio signal.

16 Claims, 12 Drawing Sheets

(51) Int. Cl.
*G10C 3/18* (2006.01)
*G10C 3/06* (2006.01)
*G10C 3/16* (2006.01)

(52) U.S. Cl.
CPC ..... *G10H 1/32* (2013.01); *G10H 2240/311* (2013.01)

(56) References Cited

U.S. PATENT DOCUMENTS 5,254,804 A 10/1993 Tamaki et al.
5,262,586 A * 11/1993 Oba ..... G10C 3/00 84/723
7,786,374 B2 * 8/2010 Valli ..... G10C 3/00 381/152
8,389,847 B2 * 3/2013 Matsuda ..... G10H 1/0091 84/625
8,878,045 B2 * 11/2014 Koseki ..... G10H 1/0091 84/616
9,245,509 B2 * 1/2016 Fujiwara ..... G10H 3/22
9,508,324 B2 * 11/2016 Ohnishi ..... G10C 3/06
2003/0015086 A1 * 1/2003 Katz ..... G10H 1/32 84/644
2007/0017353 A1 * 1/2007 Kunisada ..... G10C 1/00 84/723
2010/0083806 A1 * 4/2010 Peavey ..... G10D 3/02 84/294
2012/0247309 A1 * 10/2012 Matsuda ..... G10H 1/0091 84/735
2014/0202318 A1 * 7/2014 Ohnishi ..... G10C 3/06 84/723

OTHER PUBLICATIONS

Written Opinion issued in Intl. Appln. No. PCT/JP2015/085522 dated Feb. 23, 2016.

* cited by examiner

SOUND PRODUCING APPARATUS, KEYBOARD INSTRUMENT, AND SOUND PRODUCTION CONTROL METHOD

TECHNICAL FIELD

The present invention relates to a technology for producing sound by using a soundboard.

BACKGROUND ART

In the fields of acoustic pianos, the so-called silent piano has been commercialized that is configured to be provided with a stopper for stopping the striking of strings by hammers so as to output an electronic sound instead of a string-striking sound. The electronic sound is generally output via a headphone or the like. The electronic sound is also output by using the vibration of the soundboard, in order to make the output electronic sound more closely resemble an acoustic piano sound. For example, Patent Literature 1 discloses a technology by which a vibrator that vibrates a soundboard of an acoustic piano is used to produce, from the soundboard, sound that has been generated by an electronic sound source.

CITATION LIST

Patent Literature

Patent Literature 1: JP 2013-77000A

SUMMARY OF INVENTION

Technical Problem

According to this technology, it is also possible to enjoy an automatic performance provided by driving keys using a solenoid, instead of by key pressing operations performed by a player. With this automatic performance, sound that has been generated by an electronic sound source by driving the keys can be produced from the soundboard. On the other hand, there is also a demand to produce, from a soundboard, a sound not resulting from an automatic performance, or in other words, sound that has been generated independent of the driving of keys (e.g., a pre-recorded sound of a music piece).

It is an object of the present invention to effectively utilize the characteristics of a musical instrument when sound that has been generated independent of the driving of keys (performance operation/automatic performance) is produced from a soundboard.

Solution to Problem

According to an embodiment of the present invention, there is provided a sound producing apparatus including: a plurality of sound producing members having oscillation frequencies different from each other; dampers that are disposed so as to correspond to respective ones of the sound producing members and suppress vibration by coming into contact with the respective corresponding sound producing members; a damper operation mechanism that moves each of the dampers, thereby controlling a state of contact of the damper with a corresponding one of the sound producing members; a soundboard that undergoes sympathetic resonance with the sound producing members; a vibrator that vibrates the soundboard; an acquisition unit configured to acquire performance control data containing pitch information that specifies at least a pitch of a sound producing content; a signal output unit configured to: generate an audio signal indicating the sound producing content, on the basis of the acquired performance control data; generate a drive signal for driving the vibrator in accordance with the sound producing content, on the basis of the generated audio signal; and output the drive signal to the vibrator; and a damper control unit configured to drive the damper operation mechanism so as to change a state of contact between the sound producing members and the respective corresponding dampers, on the basis of the pitch specified by the acquired performance control data.

According to an embodiment of the present invention, there is provided a sound producing apparatus including: a plurality of sound producing members having oscillation frequencies different from each other; dampers that are disposed so as to correspond to respective ones of the sound producing members and suppress vibration by coming into contact with the respective corresponding sound producing members; a damper operation mechanism that moves each of the dampers, thereby controlling a state of contact of the damper with a corresponding one of the sound producing members; a soundboard that undergoes sympathetic resonance with the sound producing members; a vibrator that vibrates the soundboard; an acquisition unit configured to acquire an audio signal; a signal output unit configured to: generate a drive signal for driving the vibrator with a vibration corresponding to the acquired audio signal; and output the drive signal to the vibrator; and a damper control unit configured to drive the damper operation mechanism so as to change a state of contact between the sound producing members and the respective corresponding dampers, on the basis of a frequency distribution of the acquired audio signal.

According to an embodiment of the present invention, there is provided a sound producing apparatus including: a plurality of sound producing members having oscillation frequencies different from each other; dampers that are disposed so as to correspond to respective ones of the sound producing members and suppress vibration by coming into contact with the respective corresponding sound producing members; a damper operation mechanism that moves each of the dampers, thereby controlling a state of contact of the damper with a corresponding one of the sound producing members; a soundboard that undergoes sympathetic resonance with the sound producing members; a vibrator that vibrates the soundboard; an acquisition unit configured to acquire an audio signal; a signal output unit configured to: generate a drive signal for driving the vibrator with a vibration corresponding to the acquired audio signal; and output the drive signal to the vibrator; and a damper control unit configured to drive the damper operation mechanism so as to change a state of contact between the sound producing members and the respective corresponding dampers, on the basis of a sound intensity of the acquired audio signal.

According to an embodiment of the present invention, there is provided a keyboard instrument including: the above-described sound producing apparatus; keys disposed so as to correspond to respective ones of the sound producing members; hammers that each strike, as a result of one of the keys being depressed, a corresponding one of the sound producing members corresponding to the key, thereby vibrating the sound producing members; a stopper for stopping the hammers from striking the sound producing members; and a stopper control unit configured to control a state of stopping the hammers by the stopper, wherein the damper operation mechanism releases the sound producing member from the damper as a result of the key being depressed, and the damper control unit is configured to drive the key in a state where the stopper stops the hammer from striking the sound producing member, thereby driving the damper operation mechanism via the key.

According to an embodiment of the present invention, there is provided a keyboard instrument including: the above-described sound producing apparatus; keys disposed so as to correspond to respective ones of the sound producing members; and hammers that each strike, as a result of one of the keys being depressed, a corresponding one of the sound producing members corresponding to the key, thereby vibrating the sound producing member, wherein the damper operation mechanism releases the sound producing member from the damper as a result of the key being depressed, and the damper control unit is configured to drive the key so as to prevent the hammer from striking the sound producing member, thereby driving the damper operation mechanism via the key.

According to an embodiment of the present invention, there is provided a sound production control method for use in a sound producing apparatus including: a plurality of sound producing members having oscillation frequencies different from each other; dampers that are disposed so as to correspond to respective ones of the sound producing members and suppress vibration by coming into contact with the respective corresponding sound producing members; a damper operation mechanism that moves each of the dampers, thereby controlling a state of contact of the damper with a corresponding one of the sound producing members; a soundboard that undergoes sympathetic resonance with the sound producing members; and a vibrator that vibrates the soundboard, the method including the steps of: acquiring performance control data containing pitch information that specifies at least a pitch of a sound producing content; generating an audio signal indicating the sound producing content on the basis of the performance control data, and driving the vibrator in accordance with the sound producing content on the basis of the generated audio signal; and driving the damper operation mechanism so as to change a state of contact between the sound producing members and the respective corresponding dampers on the basis of the pitch specified by the performance control data.

According to an embodiment of the present invention, there is provided a sound production control method for use in a sound producing apparatus including: a plurality of sound producing members having oscillation frequencies different from each other; dampers that are disposed so as to correspond to respective ones of the sound producing members and suppress vibration by coming into contact with the respective corresponding sound producing members; a damper operation mechanism that moves each of the dampers, thereby controlling a state of contact of the damper with a corresponding one of the sound producing members; a soundboard that undergoes sympathetic resonance with the sound producing members; and a vibrator that vibrates the soundboard, the method including the steps of: acquiring an audio signal; driving the vibrator with a vibration corresponding to the audio signal; and driving the damper operation mechanism so as to change a state of contact between the sound producing members and the respective corresponding dampers, on the basis of a frequency distribution of the audio signal.

According to an embodiment of the present invention, there is provided a sound production control method for use in a sound producing apparatus including: a plurality of sound producing members having oscillation frequencies different from each other; dampers that are disposed so as to correspond to respective ones of the sound producing members and suppress vibration by coming into contact with the respective corresponding sound producing members; a damper operation mechanism that moves each of the dampers, thereby controlling a state of contact of the damper with a corresponding one of the sound producing members; a soundboard that undergoes sympathetic resonance with the sound producing members; and a vibrator that vibrates the soundboard, the method including the steps of: acquiring an audio signal; driving the vibrator with a vibration corresponding to the audio signal; and driving the damper operation mechanism so as to change a state of contact between the sound producing members and the respective corresponding dampers, on the basis of a sound intensity of the audio signal.

Advantageous Effects of Invention

According to the present invention, it is possible to effectively utilize the characteristics of a musical instrument when sound that has been generated independent of the driving of keys (performance operation/automatic performance) is produced from a soundboard.

DESCRIPTION OF EMBODIMENTS

Figure 1:
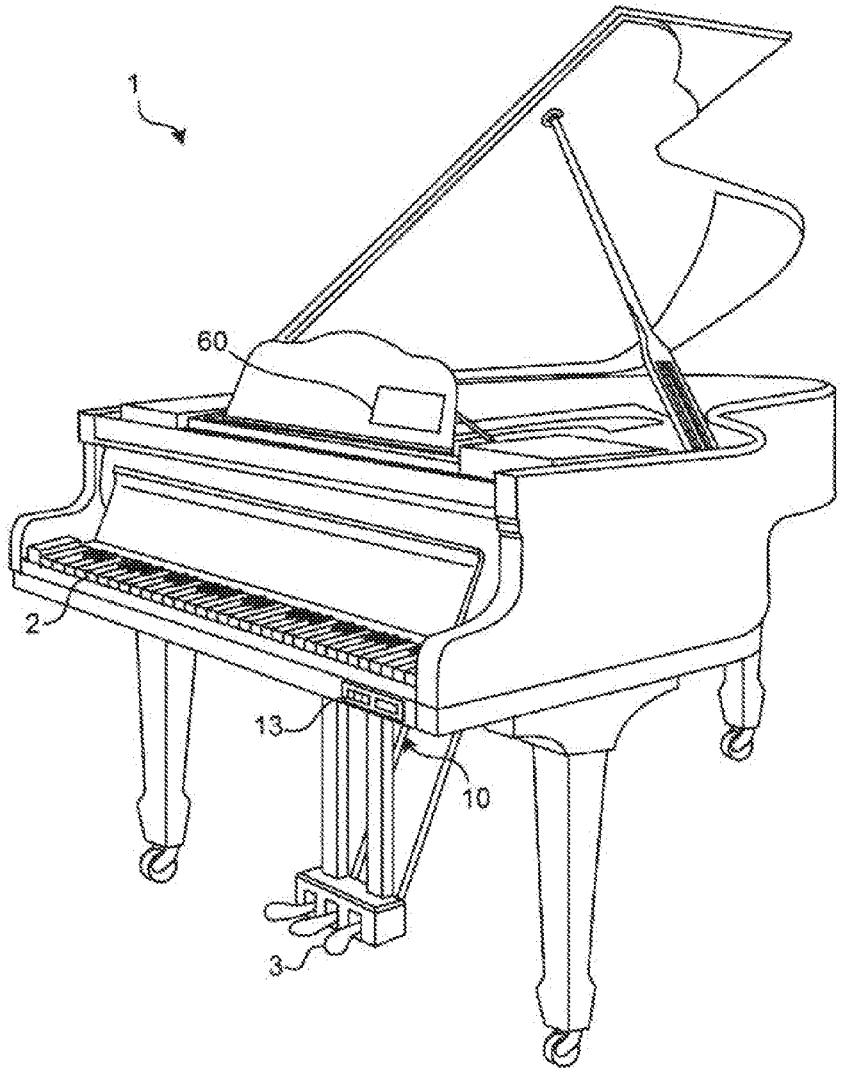
FIG. 1 is a perspective view showing an external appearance of a grand piano according to a first embodiment of the present invention.

Hereinafter, a keyboard instrument according to an embodiment of the present invention will be described in detail with reference to the drawings. The embodiments described below are merely examples of embodiments of the present invention, and the present invention is not to be construed as being limited to these embodiments. Note that in the drawings to which reference is made in the embodiments, the same portions or portions having similar functions are denoted by the same or similar reference numerals (reference numerals to which the suffix "A", "B", or the like is simply added), and redundant description thereof may be omitted. Additionally, for illustrative purpose, dimensional proportions (e.g., proportion between components, and proportions in length, width, and height directions) in the drawings may be different from the actual proportions, or some of the components may be omitted from the drawings.

First Embodiment

Overall Configuration

FIG. 1 is a perspective view showing an external appearance of a grand piano 1 according to a first embodiment of the present invention. The grand piano 1 is an example of a keyboard instrument including a keyboard having a plurality of keys 2 arranged on the front surface thereof for receiving performance operations by a player, and a pedal 3. While the grand piano 1 includes a plurality of pedals, the pedal 3 shows a damper pedal. Additionally, the grand piano 1 includes a control device 10 having an operation panel 13 on the front surface portion thereof, and a touch panel 60 provided on the music stand portion. A user instruction can be input to the control device 10 by the user operating the operation panel 13 and the touch panel 60. The grand piano 1 has a plurality of operation modes. On the basis of an operation mode that has been set in accordance with a user instruction, the control device 10 controls the operation of the components of the grand piano 1. The operation modes include a mode in which sound that has been generated without relying on the driving of the keys 2 is produced from the soundboard. The details of each of the operation modes will be described later.

Configuration of Grand Piano 1

Figure 2:
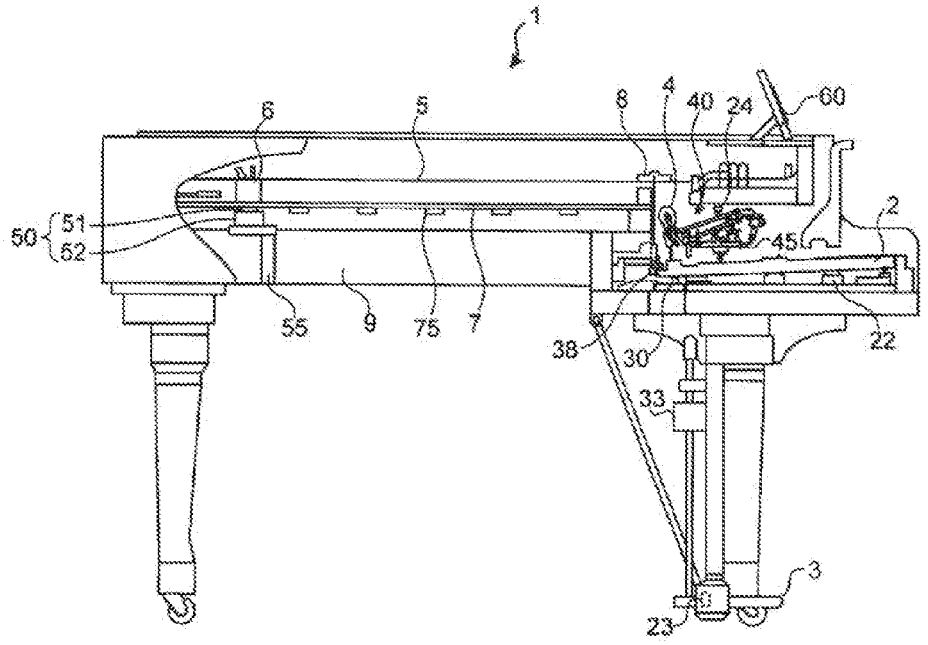
FIG. 2 is a diagram illustrating an internal structure of the grand piano according to the first embodiment of the present invention.
Figure 3:
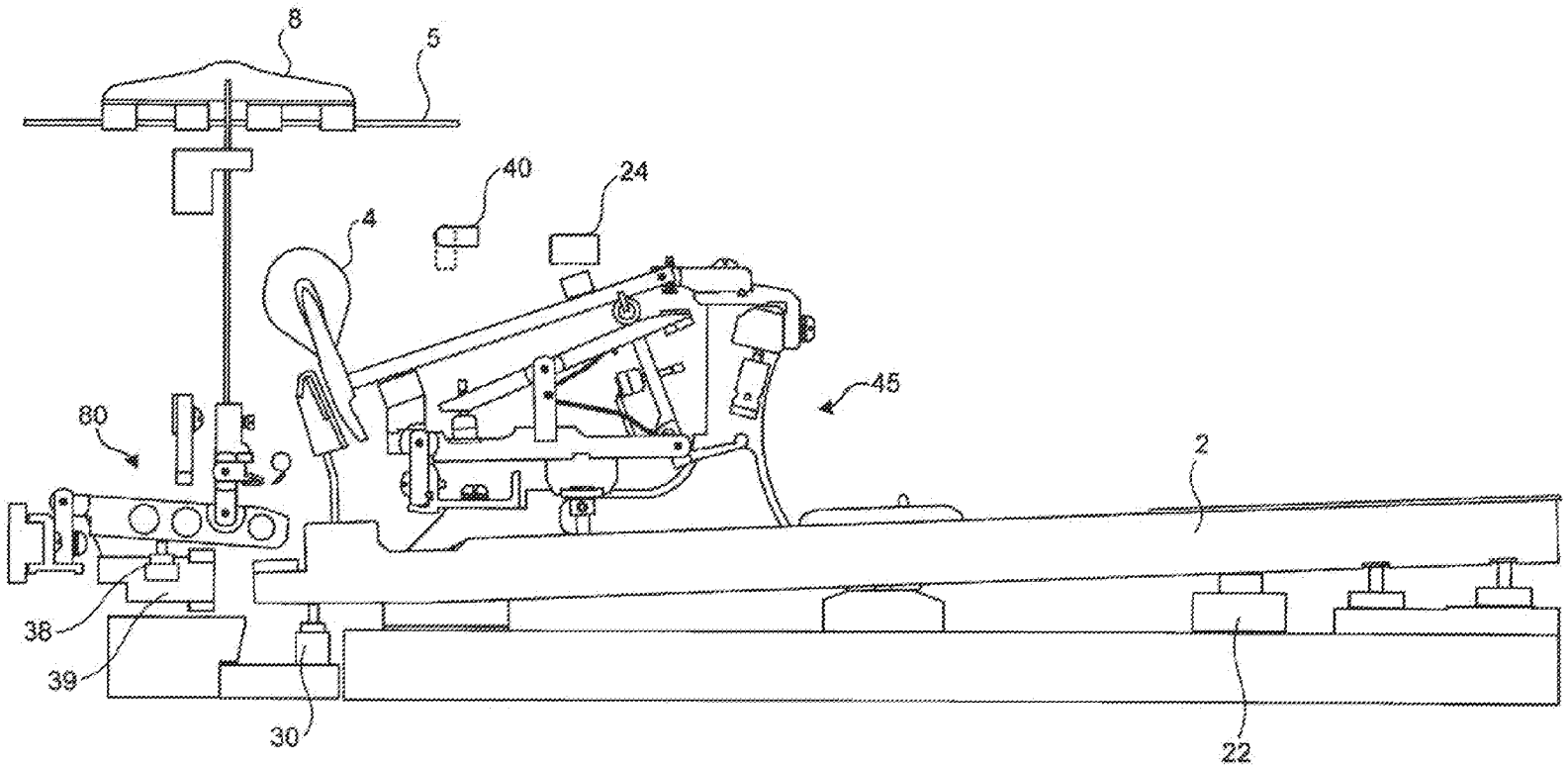
FIG. 3 is an enlarged view of the vicinity of an action mechanism of the grand piano according to the first embodiment of the present invention.

FIG. 2 is a diagram illustrating an internal structure of the grand piano 1 according to the first embodiment of the present invention. FIG. 3 is an enlarged view of the vicinity of an action mechanism of the grand piano according to the first embodiment of the present invention. In these drawings, for the components provided so as to correspond to respective ones of the keys 2, only the components provided so as to correspond to the illustrated key 2 (in this example, a white key) are shown, and the illustration of the components provided so as to correspond to respective ones of the other keys 2 has been omitted.

Below the rear end side of each of the keys 2 (the back side of the key 2 from a user playing the grand piano), a key drive device 30 that drives the key 2 by using a solenoid is provided. The key drive device 30 drives the solenoid in response to a key control signal from the control device 10. The key drive device 30 drives the solenoid to cause the plunger to ascend, thereby reproducing the same state as that provided when the user has depressed the key, and to cause the plunger to descend, thereby reproducing the same state as that provided when the user has released the key. Hammers 4 are provided so as to correspond to respective ones of the keys 2. When any one of the keys 2 is depressed, the force is transmitted via an action mechanism 45, causing the corresponding hammer 4 to strike the corresponding one of strings 5 that are provided so as to correspond to respective ones of the keys 2. Each of the strings 5 is a sound producing member that produces a sound by being struck by the corresponding hammer 4. Each of the strings 5 has an oscillation frequency corresponding to the corresponding key 2.

A damper 8 is moved by a damper operation mechanism 80. The damper operation mechanism 80 moves the damper 8 so as to control the state of contact between the damper 8 and the string 5 according to the amount of depression of the keys 2, and the amount of depression of the pedal 3. This portion has a configuration equivalent to that of a conventional grand piano. The aforementioned control of the state of contact refers to moving the damper 8 within a range from the position at which the damper 8 and the string 5 come into contact with each other so as to suppress the vibration of the string 5 (hereinafter referred to as "damping position"), to the position at which the string 5 is released from the damper 8 (hereinafter referred to as "releasing position"). In this example, a damper drive device 38 for driving the damper operation mechanism 80 without relying on the depression of the key 2 and the depression of the pedal 3 is provided. The damper drive device 38 drives the solenoid in response to a damper control signal from the control device 10. The damper drive device 38 drives the solenoid to cause the plunger to ascend, thereby driving the damper operation mechanism 80 to move the damper 8 upward, and releasing the string 5 from the damper 8. A plurality of damper drive devices 38 are provided so as to correspond to respective ones of a plurality of dampers 8 on a lifting rail 39 serving as a support portion, along the arrangement of the keys 2. Each of the damper drive devices 38 independently moves the corresponding damper 8 between the damping position and the releasing position via the damper operation mechanism 80. In this example, a pedal drive device 33 that drives the pedal 3 is provided. The pedal drive device 33 drives the solenoid in response to a pedal control signal from the control device 10, thereby mechanically reproducing a state provided when the pedal 3 has been depressed by the player. Although all the 88 keys have the respective dampers 8 in the present embodiment, it is also possible to adopt a structure in which 66 keys or 70 keys (from the lowest key) have the dampers 8, and the keys 2 for higher pitches do not have a damper 8 as in the case of a common piano. The damper drive device 38 is not operated when the pedal 3 is driven during a performance operation or by the pedal drive device 33. When the pedal 3 is operated, the lifting rail 39 that has been lifted pushes the damper operation mechanism 80 upward via the damper drive device 38, thus moving the damper 8 to the releasing position. Note that the damper drive device 38 according to the present invention may have any configuration as long as the damper drive devices 38 can independently drive the individual dampers 8, and the assembled position thereof is not limited to the lifting rail 39.

A stopper 40 is a member that collides with the hammer shank when the setting applied to the operation mode is a predetermined setting, thus stopping the hammer 4 from striking the string 5 before the string is struck. In response to a stopper control signal from the control device 10, the stopper 40 moves to either a position at which the stopper 40 collides with the hammer shank (hereinafter referred to as "stopping position") or a position at which the stopper 40 does not collide with the hammer shank (hereinafter referred to as "retracted position").

A key sensor 22 is provided below each of the keys 2, and outputs a detection signal corresponding to behavior of the corresponding key 2 to the control device 10. In this example, the key sensor 22 detects an amount of depression of the key 2 as a continuous quantity (fine resolution) and outputs a detection signal indicating a result of the detection to the control device 10. Note that, instead of outputting a detection signal corresponding to the amount of depression of the key 2, the key sensor 22 may output a detection signal indicating that the key 2 has passed through a particular depressing position. The particular depressing position is any of the positions located within a range from a rest position to an end position of the key 2, preferably a plurality of positions at which a change can be induced in the sound-producing state such as the start of sound production and the start of damping. Thus, the detection signal output from the key sensor 22 may be any signal that allows the control device 10 to recognize behavior of the key 2.

Hammer sensors 24 are provided so as to correspond to respective ones of the hammers 4, and each of the hammer sensors 24 outputs a detection signal corresponding to behavior of the corresponding hammer 4 to the control device 10. In this example, the hammer sensor 24 detects a moving velocity of the hammer 4 immediately before the hammer 4 strikes the string 5, and outputs a detection signal indicating a result of the detection to the control device 10. Note that the detection signal does not necessarily need to indicate a moving velocity itself of the hammer 4, and may use another form of detection signal to calculate the moving velocity in the control device 10. For example, a detection signal indicating that the hammer shank has passed through two positions during movement of the hammer 4 may be output, or a detection signal indicating the length of time from when the hammer shank has passed through one of the two positions until the hammer shank has passed through the other position may be output. Thus, the detection signal output from the hammer sensor 24 may be any signal that allows the control device 10 to recognize behavior of the hammer 4.

Pedal sensors 23 are provided so as to correspond to respective ones of the pedals 3, and each of the pedal sensors 23 outputs a detection signal corresponding to behavior of the corresponding pedal 3 to the control device 10. In this example, the pedal sensor 23 detects an amount of depression of the pedal 3, and outputs a detection signal indicating a result of the detection to the control device 10. Note that, instead of outputting a detection signal corresponding to an amount of depression of the pedal 3, the pedal sensor 23 may output a detection signal indicating that the pedal 3 has passed through a particular depressing position. The particular depressing position is any of the positions located within a range from a rest position to an end position of the pedal, preferably a depressing position at which distinction can be made between a state where the damper 8 and the string 5 are in complete contact with each other (damping position) and a state where they are not in contact with each other (releasing position). It is further preferable that a plurality of such particular depressing positions are used to enable the detection of a half pedal as well. Thus, the detection signal output from the pedal sensor 23 may be any signal that allows the control device 10 to recognize behavior of the pedal 3.

Note that the control device 10 may be configured to identify, for each of the keys 2 (key numbers), a striking timing (key-on timing), and a striking velocity (velocity) of the hammer 4 for the corresponding string 5 and a vibration suppressing timing (key-off timing) of the damper 8 to the string 5 on the basis of the detection signals output from the key sensor 22, the pedal sensor 23, and the hammer sensor 24. Accordingly, the key sensor 22, the pedal sensor 23, and the hammer sensor 24 may output results of detection of behavior of the corresponding key 2, pedal 3, and hammer 4 as detection signals in forms different from those of the above-described configuration.

Soundboard ribs 75 and a bridge 6 are connected to a soundboard 7 such that vibration of the soundboard 7 is transmitted to each of the strings 5 via the bridge 6, and vibration of the string 5 is transmitted to the soundboard 7 via the bridge 6. That is, the soundboard 7 and the strings 5 undergo sympathetic resonance. A vibrator 50 is connected to the soundboard 7. The vibrator 50 includes a vibration portion 51 connected to the soundboard 7, and a yoke holding portion 52 (body portion) supported by a support portion 55 connected to a vertical strut 9. A drive signal is input to the vibrator 50 from the control device 10. The vibration portion 51 vibrates in accordance with a waveform indicated by the input drive signal, thus vibrating the soundboard 7. Consequently, the bridge 6 is also vibrated. The vibration is also transmitted to those strings 5 that are released from the dampers 8.

Figure 4:
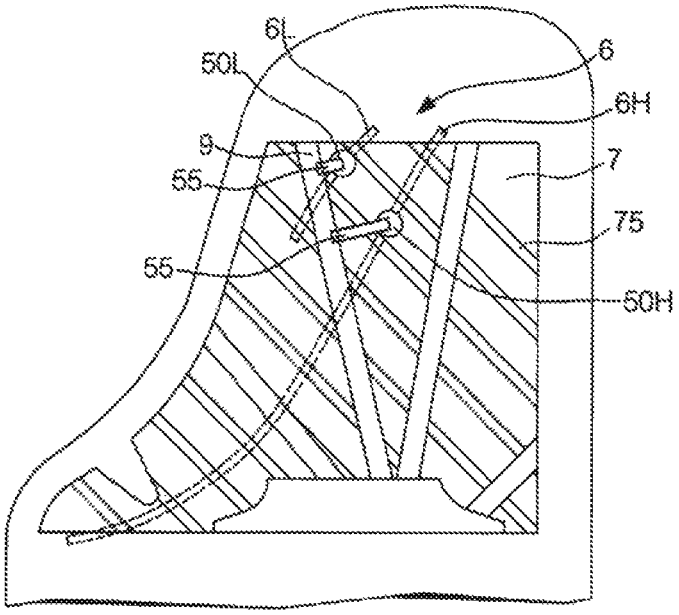
FIG. 4 is a diagram illustrating the position of a vibrator according to the first embodiment of the present invention.

FIG. 4 is a diagram illustrating the position of the vibrator 50 according to the first embodiment of the present invention. In this example, two vibrators 50H and 50L are provided as the vibrator 50. In the following description, the vibrators 50H and 50L will be collectively referred to simply as "vibrator 50" when the vibrators 50H and 50L do not need to be distinguished from each other. The vibrator 50 is connected between a plurality of soundboard ribs 75 of the soundboard 7. The vibrator 50H is provided at a position corresponding to a bridge 6H of two bridges 6 (bridge 6H (long bridge) and 6L (short bridge)). On the other hand, the vibrator 50L is provided at a position corresponding to the bridge 6L. That is, the soundboard 7 is sandwiched between the vibrator 50 and the bridge 6. Note that the number of the vibrators 50 provided on the soundboard 7 is not limited to two, and may be more. Alternatively, only one vibrator 50 may be provided. In the case where one vibrator 50 is provided when there are two bridges 6, it is desirable to provide the vibrator 50 on the long bridge 6H. The bridge 6H is a bridge that supports the strings 5 on the high-pitch side, and the bridge 6L is a bridge that supports the strings 5 on the low-pitch side. In the following description, the bridges 6H and 6L will be collectively referred to simply as "bridge 6" when the bridges 6H and 6L do not need to be distinguished from each other. Further, as described above, the vibrator 50 is supported by the support portion 55 connected to the vertical strut 9.

Note that the position at which the vibrator 50 is provided is not limited to the position of the soundboard 7 that corresponds to the bridge 6, and the vibrator 50 may be provided at a position away from the bridge 6, or may be provided at a position corresponding to any of the soundboard ribs 75. When the vibrator 50 is provided at a position corresponding to the soundboard rib 75, the vibrator 50 is provided on the side of the soundboard 7 where the strings 5 are provided. However, the installation location of the vibrator 50 may be reserved, for example, by changing the shape of the vibration portion 51.

Configuration of Vibrator 50

Figure 5:
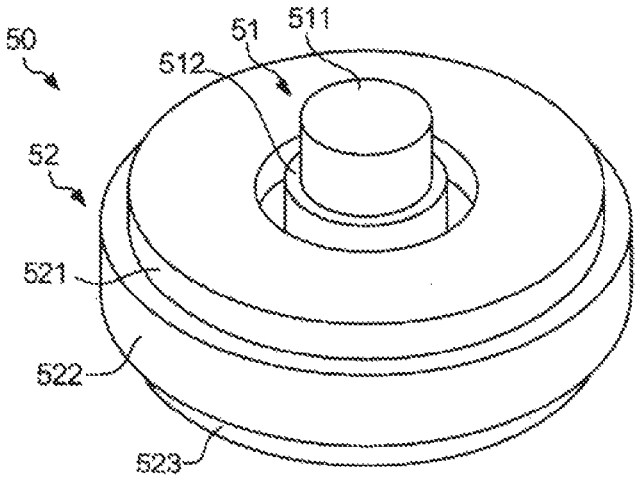
FIG. 5 is a diagram illustrating an external appearance of the vibrator according to the first embodiment of the present invention.

FIG. 5 is a diagram illustrating an external appearance of the vibrator 50 according to an embodiment of the present invention. In this drawings, to facilitate viewing of the main structure of the yoke holding portion 52, the illustration of a housing 524 (see FIG. 6) of the yoke holding portion 52 has been omitted, and only the interior of the housing 524 is illustrated. The vibration portion 51 includes a cylindrical closed-top connection member 511 connecting to the soundboard 7, and a voice coil 512. The connection member 511 is formed of a light material such as a resin (e.g., polyimide) or a metal made of an aluminum material, and a cap such as a resin cap is attached to the upper surface portion thereof. The yoke holding portion 52 includes a magnet 522, and yokes 521 and 523 that sandwich the magnet 522 therebetween. The yokes 521 and 523 are each formed of a soft magnetic material such as soft iron, and thus are very heavier than the connection member 511. The vibration portion 51 and the yoke holding portion 52 are separated from each other by a space.

Figure 6:
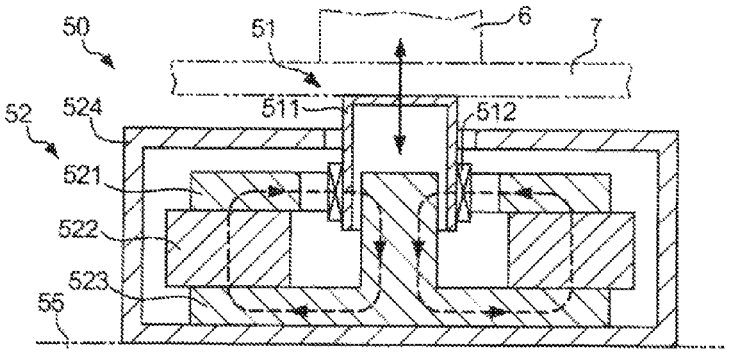
FIG. 6 is a cross-sectional view of the vibrator shown in FIG. 5, taken along a plane that passes through the center of a connection member and is parallel to a vibration direction of the connection member 511.

FIG. 6 is a cross-sectional view of the vibrator 50 shown in FIG. 5, taken along a plane that passes through the center of the connection member 511 and is parallel to a vibration direction of the connection member 511. In FIG. 6, the housing 524 that has been omitted from the illustration in FIG. 5 is also illustrated. In FIG. 6, the positions of the soundboard 7 and the bridge 6 are indicated by broken lines to illustrate the positional relationship between the vibrator 50, the soundboard 7, and the bridge 6. The vibration portion 51 includes the connection member 511 and the voice coil 512. The voice coil 512 is disposed so as to be located on, among magnetic paths formed by the yokes 521 and 523 and the magnet 522 (broken-line arrows), a magnetic path passing through the space formed between the yoke 521 and the yoke 523. The drive signal input to the vibrator 50 is input to the voice coil 512. Under a magnetic force on the magnetic path formed in the above-described manner, the voice coil 512 produces a driving force so that the connection member 511 vibrates in the up-down direction in the drawing, in accordance with a waveform indicated by the input drive signal. At this time, the yoke holding portion 52 is supported by the support portion 55, and thus the position thereof is fixed. Accordingly, most of the driving force produced by the voice coil 512 is used as a thrust for vibrating the connection member 511.

The upper surface of the connection member 511 and the soundboard 7 are bonded to each other with an adhesive, double-sided tape (not shown), or the like, thus fixing the connection member 511 to the soundboard 7. Note that the upper surface of the connection member 511 and the soundboard 7 do not necessarily need to be connected to each other by bonding, and may be connected to each other by screwing or the like. The connection member 511 and the soundboard 7 may be connected to each other via a relay member for detachably fixing the two components, without being directly fixed. Thus, the soundboard 7 is pressed upward when the connection member 511 moves upward. When the connection member 511 moves downward, the soundboard 7 is pulled downward by the connection member 511, instead of the connection member 511 moving away from the soundboard 7. In this manner, the vibration of the connection member 511 is applied to the bridge 6 via the soundboard 7, and is further transmitted to the strings 5. However, the transmitted vibration is suppressed for those of the strings 5 with which the dampers 8 are in contact.

The housing 524 houses the yokes 521 and 523 and the magnet 522. The housing 524 is supported by the support portion 55. At this time, the yoke holding portion 52, which is composed of the yokes 521 and 523, the magnet 522, and the housing 524, is supported by the support portion 55 at a position that is separated from the vibration portion 51 by a space and is not in contact with the soundboard 7. In this example, the support portion 55 supports the yoke holding portion 52 from the lower surface side of the housing 524, as shown in FIG. 5. Since the vibration portion 51 (the connection member 511) is separated from the yoke holding portion 52 by a space, the vibration portion 51 is supported by the soundboard 7 by being connected to the soundboard 7. The expression "the vibration portion 51 is separated from the yoke holding portion 52 by a space" describes that the vibration portion 51 and the yoke holding portion 52 are not in contact with each other in the illustrated configuration, and some components (e.g., wiring that is led to the voice coil 512) connecting to the vibration portion 51 may be in contact with the yoke holding portion 52. That is, the vibration portion 51 and the yoke holding portion 52 may be in an indirect contact with each other. At this time, it is desirable that no load applied by gravity or the like to the yoke holding portion 52 will act on the vibration portion 51 by the above-described components.

As a result of the yoke holding portion 52 of the vibrator 50 being supported by the support portion 55 in this configuration, no load other than that of the vibration portion 51 of the vibrator 50 acts on the soundboard 7. Here, the connection member 511 is formed of a lighter material such as a resin than the members constituting the yoke holding portion 52. In addition, the vibration portion 51 as a whole, including the voice coil 512, is also very light component as compared with the yoke holding portion 52. Since the load applied by gravity or the like to the yoke holding portion 52 acts on the vertical strut 9 via the support portion 55, most of the load of the vibrator 50 will not act on the soundboard 7. Although the load of the vibration portion 51 acts on the soundboard 7, such a load is little and has very little effect on the vibration characteristics of the soundboard 7. Although it is desirable that substantially no load of the vibrator 50 acts on the soundboard 7, it is possible to adopt a configuration in which a load other than that of the vibration portion 51 acts on the soundboard 7. That is, it is possible to adopt a configuration in which the vibrator 50 is directly attached to the soundboard 7, without the use of the support portion 55. Further, the illustrated driving form is merely an example, and the present invention is not limited to such a configuration. For example, if the vibration characteristics of the soundboard 7 may be sacrificed to some extent, it is possible to adopt, for example, a configuration in which a drive portion is placed on the soundboard without the use of the support portion 55, the positional relationship with the soundboard 7 is maintained by the self weight of the drive portion including the yokes and the magnet, and a connection member that moves up and down within the drive portion vibrates the soundboard 7. This completes the description of the vibrator 50.

Configuration of Control Device 10

Figure 7:
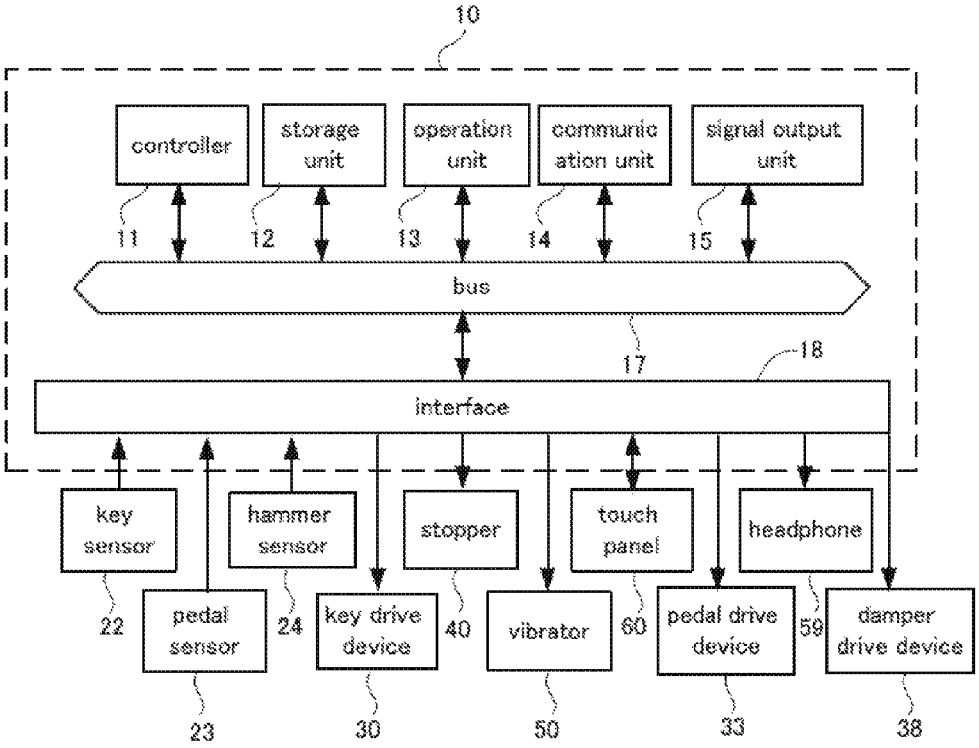
FIG. 7 is a block diagram showing a configuration of a control device according to the first embodiment of the present invention.

FIG. 7 is a block diagram showing a configuration of a control device according to the first embodiment of the present invention. The control device 10 includes a controller 11, a storage unit 12, an operation panel 13, a communication unit 14, a signal output unit 15, and an interface 16. These components are connected to each other via a bus 17.

The controller 11 includes an arithmetic device such as a CPU (Central Processing Unit), and storage devices such as a ROM (ReadOnly Memory) and a RAM (Random Access Memory). On the basis of control programs stored in the storage devices, the controller 11 controls various units of the control device 10 and various components connected to the interface 16. In this example, the controller 11 causes the control device 10 and some of the components connected to the control device 10 to function as the keyboard instrument according to the present invention by executing the control programs. Control signals are used to control the various components. Examples of the control signals include the above-described key control signal, stopper control signal, damper control signal, and pedal control signal. The control device 10 controls the grand piano 1 according to the set operation mode. The operation modes that can be set for the grand piano 1 will be described later.

The storage unit 12 stores various types of information such as setting information, music piece data, and performance control data. The music piece data is data that indicates an audio signal indicating a sound producing content of a music piece. The format of the music piece data may be, for example, any of various coding formats such as WAV and MP3. The performance control data is control data that specifies the control data specifying a performance content by sound production/sound stopping controls with the time progression. For example, the performance control data contains performance information such as pitch information that designates a pitch of the sound producing content and period information that specifies a sound producing period, and can be used for an automatic performance or the like. The format of the performance control data may be MIDI data, for example. In the case of MIDI data, the pitch information corresponds to a key number, and the period information corresponds to, for example, a period from a note-on to a note-off, or a duration (gate time). The setting information indicates various settings that are used during execution of the control programs. Examples of the setting information include information necessary for determining the content of the drive signal output from the signal output unit 15, on the basis of the detection signals output from the key sensor 22, the pedal sensor 23 and the hammer sensor 24, and information indicating the operation mode set by the user and the settings applied in the operation modes.

The operation panel 13 includes, for example, operation buttons for receiving a user operation. Upon receipt of a user operation via the operation buttons, an operation signal corresponding to the operation is output to the controller 11. The touch panel 60 connected to the interface 16 includes a display screen such as a liquid crystal display, and a touch sensor for receiving a user operation is provided on the surface portion of the display screen. On the display screen, a setting screen for changing the content of the setting information by providing various settings, and various types of information on a musical score and the like of the set music piece are displayed under control of the controller 11 via the interface 16. Upon receipt of a user operation via the touch panel 60, an operation signal corresponding to the operation is output to the controller 11 via the interface 16. That is, instructions from the user to the control device 10 are input through operations received via the operation panel 13 or the touch panel 60.

The communication unit 14 is an interface for communicating with other devices in a wireless, wired, or other form of communication. To the interface, a disk drive that reads out various data recorded on a recording medium such as a DVD (Digital Versatile Disk) and a CD (Compact Disk) and outputs the read-out data may be connected. Alternatively, a semiconductor memory or the like may be connected, or an external device such as a server may be connected via a network. The data input to the control device 10 via the communication unit 14 may be, for example, the above-described music piece data or music piece data of an audio signal itself, or may be performance control data or the above-described control programs.

Figure 8:
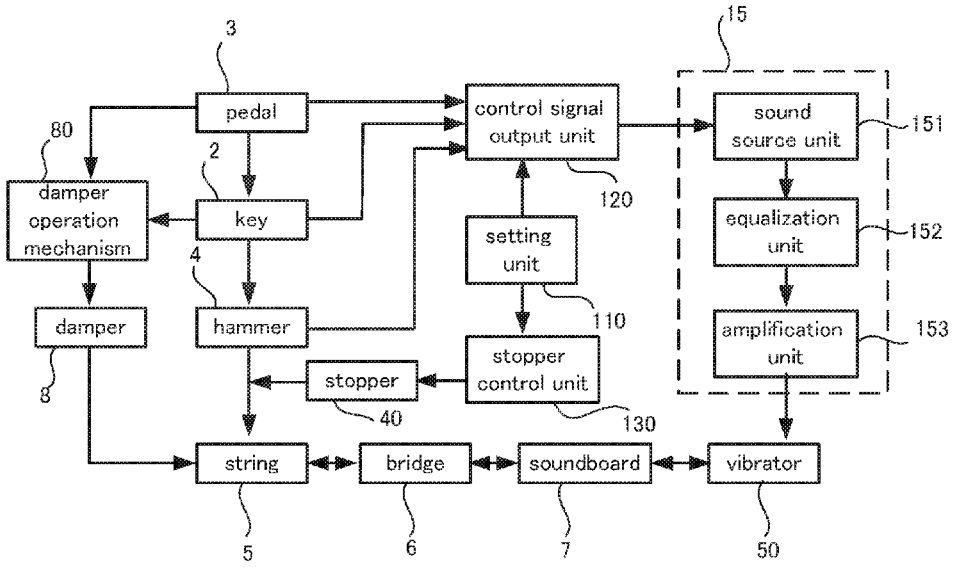
FIG. 8 is a block diagram showing a functional configuration of the grand piano when a manual performance mode is set, according to the first embodiment of the present invention.

The signal output unit 15 outputs a drive signal for driving the vibrator 50 in accordance with the control of the controller 11. For example, as shown in FIG. 8, which will be described later, the signal output unit 15 includes a sound source unit 151 that outputs an audio signal in accordance with an instruction from the controller 11, an equalization unit 152 that adjusts the frequency distribution of the audio signal, and an amplification unit 153 that amplifies the audio signal (see FIG. 8, etc). The sound source unit 151 generates an audio signal in accordance with the performance control data, and generate audio signals in accordance with detection signals from the key sensor 22, the pedal sensor 23, the hammer sensor 24, for example. The signal output unit 15 further includes a decoding unit 155 that decodes the music piece data that has been coded in any of various formats (see FIG. 10). Like the audio signal output from the sound source unit 151, the audio signal output from the decoding unit 155 is input to the equalization unit 152. The signal output unit 15 outputs, as a drive signal, the audio signal amplified by the amplification unit 153.

The interface 16 is an interface for connecting the control device 10 with various external components. In this example, the external components connected to the interface 16 are the key sensor 22, the pedal sensor 23, the hammer sensor 24, the key drive device 30, the stopper 40, the vibrator 50, the touch panel 60, the pedal drive device 33, and the damper drive device 38. The interface 16 outputs, to the controller 11, detection signals output from the key sensor 22, the pedal sensor 23, and the hammer sensor 24, and an operation signal output from the touch panel 60. Additionally, the interface 16 outputs a key control signal to the key drive device 30, a stopper control signal to the stopper 40, a pedal control signal to the pedal drive device 33, a damper control signal to the damper drive device 38, and a drive signal to the vibrator 50. Further, the interface 16 includes a headphone terminal to which the headphone 59 is connected. An audio signal generated in the signal output unit 15 is supplied to the headphone terminal.

Operation Modes and Settings Applicable to Operation Modes

Next, operation modes applicable to the grand piano 1 will be described. Any of a plurality of operation modes is selectively set for the grand piano 1. In this example, the plurality of operation modes are four operation modes, namely, a manual performance mode, an automatic performance mode, an audio listening mode, and an electronic sound listening mode. In the manual performance mode and the automatic performance mode, either a normal setting, a soft sound setting, a loud sound setting, or a silent setting is applicable. In the audio listening mode and the electronic sound listening mode, either a damper stationary setting, a damper driving setting, or a key driving setting is applicable. The operation modes and the settings applied thereto will now be described.

(1) Manual Performance Mode

A mode that is used when a player operates the keys 2 to give a performance.

(2) Automatic Performance Mode

A mode in which the keys 2 are driven by the key drive devices 30 in accordance with performance control data, instead of the player operating the keys 2.

In the manual performance mode and the automatic performance mode, the following four types of settings are applicable.

(A) Normal Setting

A mode that is used when the grand piano 1 is played as a regular piano. At this time, the stopper 40 has been moved to the retracted position. The vibrator 50 does not vibrate the soundboard 7. At this time, when the vibrator 50 is configured as described above, only the load of the vibration portion 51, which is a very light portion of the vibrator 50, acts on the soundboard 7. Accordingly, the vibrator 50 has substantially no effect on the vibration characteristics of the soundboard 7 itself, so that the player can give a performance without compromising the original acoustic properties of the acoustic piano.

(B) Soft Sound Setting

A mode in which the striking of strings through operation of the keys 2 is prevented, and the soundboard 7 is vibrated by the vibrator 50 so as to produce an electronic sound by a performance given by the player. Accordingly, the stopper 40 has been moved to the stopping position so as to prevent the striking of strings. The vibrator 50 vibrates the soundboard 7 in accordance with a drive signal generated on the basis of the player's performance. Since no striking of strings is carried out and sound is produced from the soundboard 7, the overall performance as a whole can be given with a soft sound. Further, as a result of a drive signal being generated on the basis of a sound other than (including a sound similar to a piano sound) a piano sound, a sound other than a piano sound can also be produced. Note that this mode is not limited to producing a sound smaller than a sound of a normal performance (performance by the striking of strings) from the soundboard 7, and a larger sound may also be produced by adjusting the amplitude of vibration of the vibrator 50. That is, the soft sound setting does not necessarily indicate production of a sound smaller than a sound produced in the normal setting, but rather indicates that the string 5 vibrated by being struck either produces a soft sound or no sound, and an electronic sound is produced in a state where the striking of strings through depression of the key is not carried out. At this time, the string 5 corresponding to the depressed key 2 is released from the damper 8, so that it is also possible to cause the string 5 to resonate with the electronic sound.

(C) Loud Sound Setting

A mode in which the striking of strings is carried out through operation of the keys 2, and the soundboard 7 is vibrated by the vibrator 50 so as to produce an electronic sound by a performance given by the player. Accordingly, the stopper 40 has been moved to the retracted position. The vibrator 50 vibrates the soundboard 7 in accordance with a drive signal generated on the basis of a performance given by the player. Since the striking of strings is carried out and also a sound is produced from the soundboard 7, the performance as a whole can be given with a louder sound than a sound produced only by the striking of strings. Further, as a result of a drive signal being generated on the basis of sound other than (including a sound similar to a piano sound) a piano sound, it is also possible to produce a sound by mixing a sound other than a piano sound with a string-striking sound. That is, a tone color layer effect can be achieved. As in the case of the soft sound setting, it is also possible to cause the string 5 corresponding to the depressed key 2 to resonate.

(D) Silent Setting

A mode in which the striking of strings is prevented by the stopper 40 during driving of the keys 2 by the player or the automatic performance, and the soundboard 7 is not vibrated by the vibrator 50. At this time, the stopper 40 has been moved to the stopping position. In place of the drive signal output to the vibrator 50, an audio signal generated in the signal output unit 15 is supplied to the headphone 59.

(3) Audio Listening Mode

A mode in which a sound of a pre-recorded music piece or the like is produced by vibrating the soundboard 7 by the vibrator 50, without relying on a performance given by the player, or in other words, without an operation of the keys 2. In this example, the vibrator 50 vibrates the soundboard 7 in accordance with a drive signal generated by the signal output unit 15 on the basis of the music piece data.

(4) Electronic Sound Listening Mode

A mode in which an electronic sound of a previously prepared music piece or the like is produced by vibrating the soundboard 7 by the vibrator 50, without relying on a performance given by the player, or in other words, without an operation of the keys 2. In this example, the vibrator 50 vibrates the soundboard 7 in accordance with a drive signal generated by the signal output unit 15 on the basis of the performance control data.

In the audio listening mode and the electronic sound listening mode, the following three types of settings are applicable.

(A) Damper Stationary Setting

The position of the damper 8 remains stationary at the damping position. That is, a sound is produced by vibrating the soundboard 7 by the vibrator 50.

(B) Damper Driving Setting

The position of the stopper 40 may be at either the retracted position or the stopping position. The damper 8 is driven by the damper drive device 38 via the damper operation mechanism 80 so as to move between the damping position and the releasing position. The position of the damper 8 with respect to the corresponding key 2 changes depending on the content of the drive signal (or audio signal) output to the vibrator 50. That is, a sound is produced by vibrating the soundboard 7 by the vibrator 50, and also the vibration from the soundboard 7 is transmitted to the string 5 corresponding to the damper 8 located at the releasing position. Consequently, the string 5 for which the damper 8 is at the releasing position and the soundboard 7 undergo sympathetic resonance.

(C) Key Driving Setting

This setting is substantially the same as the damper driving setting except that, in order to move the damper 8, the damper operation mechanism 80 is driven by driving the key 2 by using the key drive device 30, instead of driving the damper operation mechanism 80 by using the damper drive device 38. Accordingly, in this example, the position of the stopper 40 has been moved to the stopping position. Note that the stopper 40 may be moved to the retracted position. However, in that case, the key 2 is driven to such a degree that the hammer 4 will not strike the string 5 while the damper 8 is being moved to the releasing position. For example, the depressing velocity of the keys 2 may be reduced to a predetermined velocity or less. As a result, as in the case of the damper driving setting, the string 5 for which the damper 8 is at the releasing position and the soundboard 7 undergo sympathetic resonance.

The method for determining the position of the damper 8 corresponding to each of the keys 2 (the state of contact between the damper 8 and the string 5) in the damper driving setting (B) and the key driving setting (C) will be described later. This method differs between the audio listening mode and the electronic sound listening mode.

When controlling the components of the grand piano 1, the control device 10 performs different controls depending on the above-described operation modes and the settings applied to the operation modes. As for the operation modes and the settings, all of the above-described details are not necessarily present, and only some of the operation modes may be present. As for the settings applied to the operation modes as well, only some of the settings may be present.

Functional Configuration of Grand Piano 1

The functional configuration of the grand piano 1 is different depending on the operation mode. The functional configurations in the manual performance mode, the automatic performance mode, the audio listening mode, and the electronic sound listening mode will be described in order.

(1) Manual Performance Mode

FIG. 8 is a block diagram showing a functional configuration of the grand piano when a manual performance mode is set, according to the first embodiment of the present invention. As shown in FIG. 8, when the key 2 is operated, the hammer 4 strikes the string 5, so that the string 5 vibrates. This vibration is transmitted via the bridge 6 to the soundboard 7. Further, the damper 8 is moved to the releasing position by the action mechanism 45 pushing the damper operation mechanism 80 upward through the operation of the key 2, or pushing the damper operation mechanism 80 upward via the lifting rail 39 through the operation of the pedal 3. By the damper 8 moving between the damping position and the releasing position, the state of suppression of the vibration of the string 5 is changed. The vibrator 50 vibrates in response to the drive signal input from the signal output unit 150, thus vibrating the soundboard 7. The vibration of the soundboard 7 is transmitted to the bridge 6, and then further transmitted to the string 5 as well. Note that the degree to which the vibration is transmitted to the string 5 changes with the state of contact between the damper 8 and the string 5.

The setting unit 110 is implemented as a component having the following function by means of the touch panel 60 (or may be the operation panel 13) and the controller 11. First, the touch panel 60 receives a user operation that instructs an operation mode and a setting. The setting unit 110 changes the setting information in accordance with the operation mode and the setting instructed by the user. The setting information is changed to one of the normal setting, the soft sound setting, the loud sound setting, and the silent setting that has been applied to the manual performance mode on the basis of a user instruction. On the basis of this setting information, the setting unit 110 controls the operation details of the control signal output unit 120, the stopper control unit 130, and the signal output unit 15. The setting unit 110 receives, via the touch panel 60, a user operation for setting various control parameters in the signal output unit 15. The various control parameters are parameters for determining, for example, a tone color of the musical tone indicated by an audio signal output from sound source unit 151, a form of frequency distribution adjustment in the equalization unit 152, and an amplification factor in the amplification unit 153. Note that it is also possible to adopt a configuration in which the equalization unit 152 and the amplification unit 153 use only pre-set parameters, and the parameter change by the setting unit 110 is not carried out.

The control signal output unit 120 is implemented as a component having the following function by means of the controller 11, the key sensor 22, the pedal sensor 23, and the hammer sensor 24. The key sensor 22, the pedal sensor 23, and the hammer sensor 24 detect behaviors of the key 2, the pedal 3, and the hammer 4, respectively. On the basis of the consequently output detection signals, the control signal output unit 120 outputs a control signal for controlling the sound source unit 151. The control signal contains performance information indicating a striking timing (key-on timing) of the string 5 by the hammer 4, the number (key number) of the key 2 corresponding to the struck string 5, a striking velocity (velocity), and a vibration suppressing timing (key-off timing) of the damper 8 for the string 5. In this example, the control signal output unit 120 identifies the striking timing and the key number of the key 2 on the basis of behavior of the key 2, the striking velocity on the basis of behavior of the hammer 4, and the vibration suppressing timing on the basis of behaviors of the key 2 and the pedal 3. Note that the striking timing may be identified on the basis of behavior of the hammer 4, and the striking velocity may be identified on the basis of behavior of the key 2. Additionally, the performance information may constitute performance control data in a MIDI (Musical Instrument Digital Interface) format, for example.

At the identified key-on timing, the control signal output unit 120 outputs, to the sound source unit 151, performance information indicating a key number, a velocity, and a key-on. At the key-off timing, the control signal output unit 120 output, to the sound source unit 151, performance information indicating a key number and a key-off. Note that the control signal output unit 120 executes the above-described process when one of the soft sound setting, the loud sound setting, and the silent setting is applied, and does not execute the above-described process when the normal setting is applied.

The stopper control unit 130 is implemented as a component having the following function by means of the controller 11. The stopper control unit 130 moves the stopper 40 to the stopping position in accordance with the stopper control signal when one of the soft sound setting and the silent setting is applied. On the other hand, the stopper control unit 130 moves the stopper 40 to the retracted position when one of the normal setting and the loud sound setting is applied.

On the basis of the performance information (control signal) output from the control signal output unit 120 (the controller 11), the sound source unit 151 generates an audio signal and outputs the audio signal. For example, the sound source unit 151 generates an audio signal so as to provide a pitch corresponding to the key number and a sound volume corresponding to the velocity. As described above, this audio signal is adjusted in frequency distribution by the equalization unit 152, amplified in the amplification unit 153, and output as a drive signal to the vibrator 50. Note that when the silent setting is applied, the signal output unit 15 outputs an audio signal to the headphone 59 connected to the interface 16, without outputting a drive signal to the vibrator 50.

(2) Automatic Performance Mode

Figure 9:
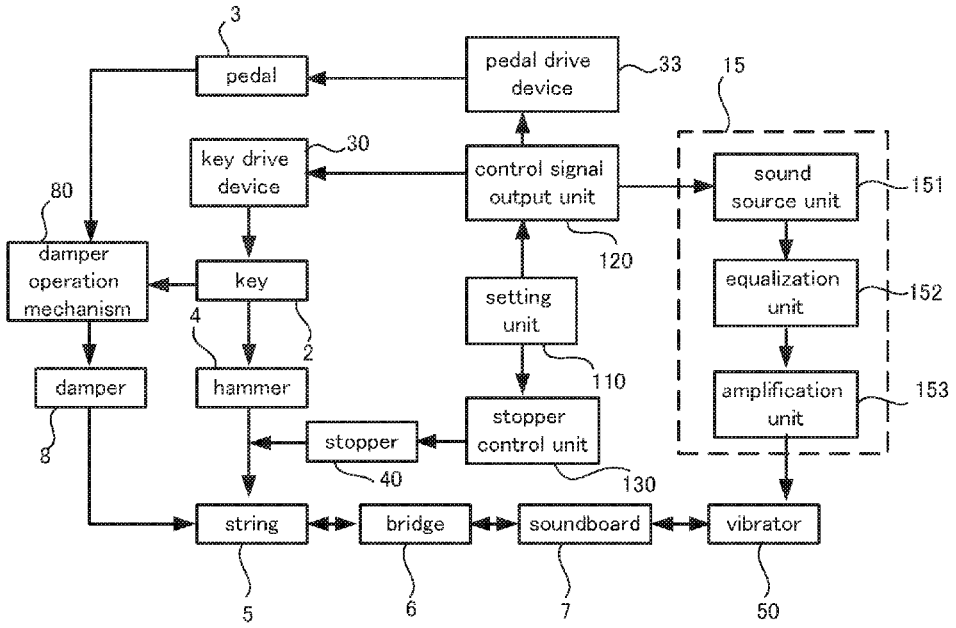
FIG. 9 is a block diagram showing a functional configuration of the grand piano when an automatic performance mode is set, according to the first embodiment of the present invention.

FIG. 9 is a block diagram showing a functional configuration of the grand piano when an automatic performance mode is set, according to the first embodiment of the present invention. This description is focused on differences between the automatic performance mode and the manual performance mode. The setting unit 110 further sets a music piece for giving an automatic performance. The setting information is changed to one of the normal setting, the soft sound setting, the loud sound setting, and the silent setting that has been applied to the automatic performance mode on the basis of a user instruction.

A control signal output unit 180 is implemented as a component having the following function by means of the controller 11. When one of the soft sound setting, the loud sound setting, and the silent setting is applied, the control signal output unit 180 generates performance information on the basis of the performance control data corresponding to the music piece that has been set by the setting unit 110, and outputs the performance information to the sound source unit 151. Consequently, the sound source unit 151 generates an audio signal corresponding to the performance information, as in the case of the manual performance mode.

According to this performance information, the control signal output unit 180 outputs a key control signal for driving the key 2 to the key drive device 30, and outputs a pedal control signal for driving the pedal 3 to the pedal drive device 33. The key control signal and the pedal control signal are output when any of the normal setting, the soft sound setting, the loud sound setting, and the silent setting is applied. Like the control signal output unit 120, the control signal output unit 180 may generate performance information to be output to the sound source unit 151, in accordance with behavior of the key 2 or the like that is driven on the basis of its control signal.

The stopper control unit 130 moves the stopper 40 to the stopping position in accordance with the stopper control signal when one of the soft sound setting and the silent setting is applied. On the other hand, the stopper control unit 130 moves the stopper 40 to the retracted position when one of the normal setting and the loud sound setting is applied.

(3) Audio Listening Mode

Figure 10:
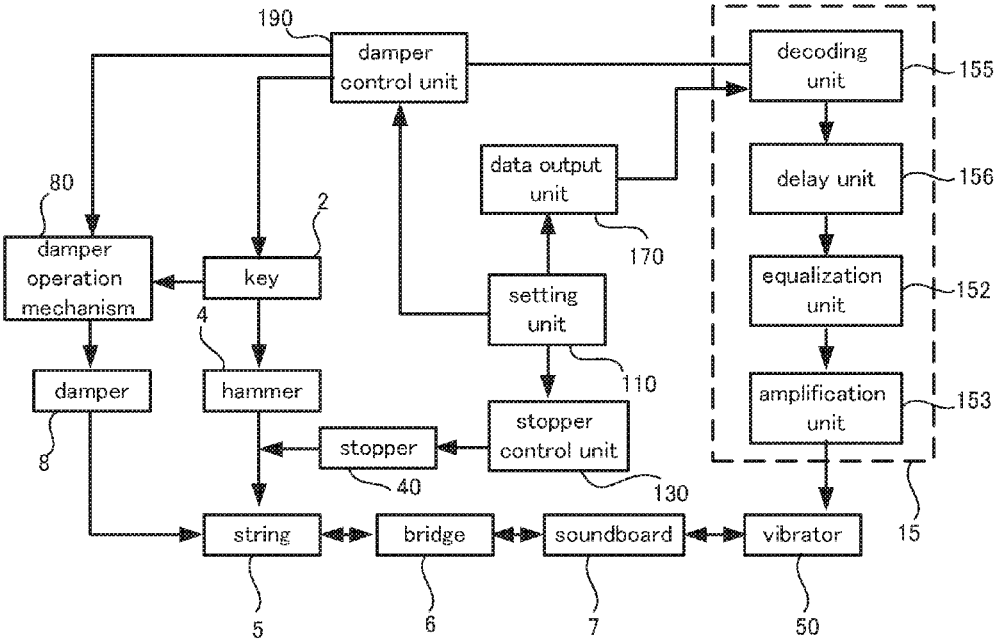
FIG. 10 is a block diagram showing a functional configuration of the grand piano when an audio listening mode is set, according to the first embodiment of the present invention.

FIG. 10 is a block diagram showing a functional configuration of the grand piano when an audio listening mode is set, according to the first embodiment of the present invention. This description is focused on differences between the automatic performance mode and the manual performance mode. The setting unit 110 sets a music piece that is to be listened to. The setting information is changed to one of the damper stationary setting, the damper driving setting, and the key driving setting that has been applied to the audio listening mode in accordance with a user instruction.

The stopper control unit 130 causes the stopper control unit to move the stopper 40 to the stopping position when the key driving setting is applied. A data output unit 170 is implemented as a component having the following function by means of the controller 11. The data output unit 170 outputs, to the decoding unit 155, music piece data corresponding to the music piece that has been set by the setting unit 110. The decoding unit 155 acquires an audio signal by decoding the music piece data coded in a WAV format, an MP3 format, or the like. For example, when receiving an audio signal itself as the music piece data from the communication unit 14, the decoding unit 155 directly acquires the audio signal. The decoding unit 155 outputs the acquired audio signal to a damper control unit 190 and a delay unit 156. The delay unit 156 delays the audio signal output from the decoding unit 155, and outputs the delayed audio signal to the equalization unit 152. The amount of delay in the delay unit 156 is set so as to correspond to the processing time in the damper control unit 190.

The damper control unit 190 is implemented as a component having the following function by means of the key drive device 30, the damper drive device 38, and the controller 11. When the damper stationary setting is applied, the damper control unit 190 holds all of the dampers 8 in a state where they have been moved to the damping position, without controlling the damper operation mechanism 80. On the other hand, in the key driving setting and the damper driving setting, the damper control unit 190 controls the damper operation mechanism 80 so as to change the state of contact between the damper 8 and the string 5 on the basis of a frequency distribution of the audio signal input from the decoding unit 155. When the key driving setting is applied, the damper control unit 190 controls the damper operation mechanism 80 via driving of the key 2. That is, the damper control unit 190 brings the key 2 into a depressed state by driving the key drive device 30 in accordance with the key control signal, thereby pushing the damper operation mechanism 80 upward so as to move a particular damper 8 to the releasing position. On the other hand, when the damper driving setting is applied, the damper control unit 190 drives the damper drive device 38 in accordance with the damper control signal, thereby pushing the damper operation mechanism 80 upward so as to move a particular damper 8. In this way, the key driving setting and the damper driving setting differ in the method for moving the damper 8 (the method for pushing the damper operation mechanism 80 upward), but are set such that the control of the position of the damper 8 is the same. The method for controlling the positions of the damper 8 in the damper control unit 190 will now be described.

Figure 11:
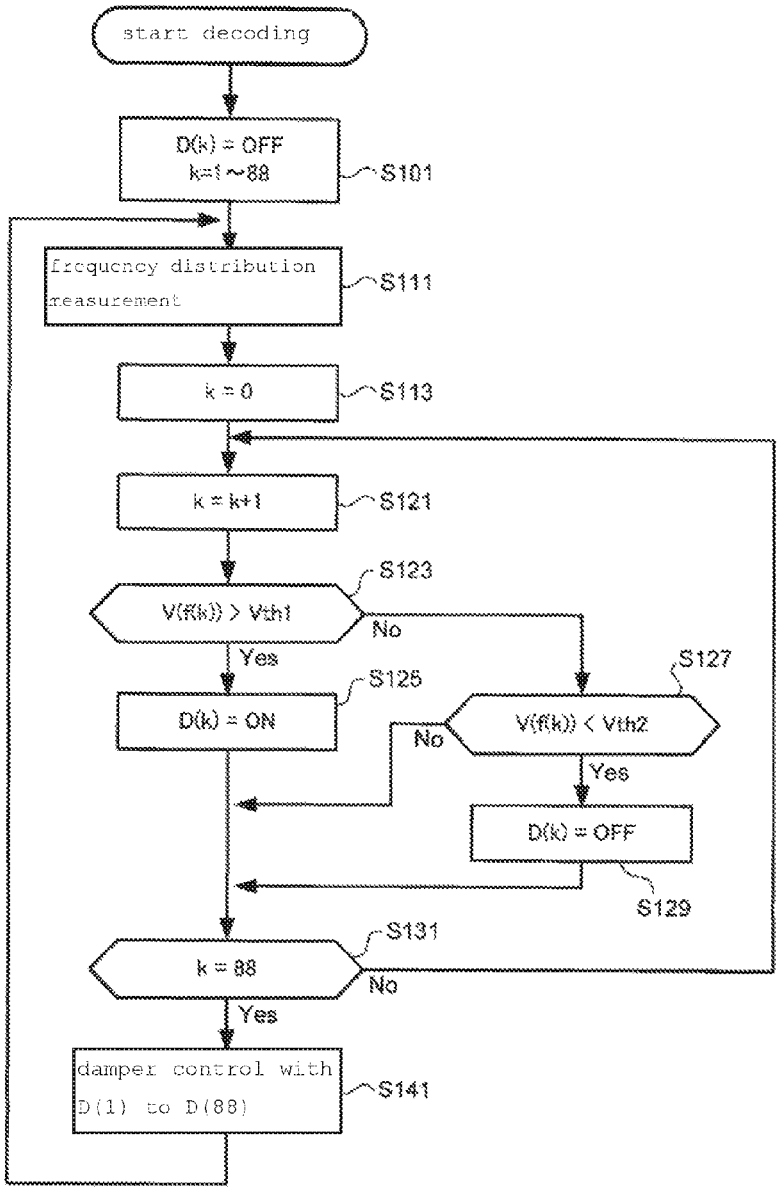
FIG. 11 is a flowchart illustrating a position control process for dampers according to the first embodiment of the present invention.

FIG. 11 is a flowchart illustrating a position control process for dampers according to the first embodiment of the present invention. When decoding in the decoding unit 155 is started, the damper control unit 190 performs the position control process for the dampers 8.

First, a reset process is performed, namely, D(k)=OFF is set for all "k" (step S101). Here, "k" is "1" to "88", and indicates the placement locations of the keys 2. For example, k=1 indicates the key 2 having the lowest pitch, and k=88 indicates the key 2 having the highest pitch. As described above, in the case of a structure such as that of a common piano including dampers for 66 keys or 70 keys from the lowest pitch, the process is performed with "k" set to "1" to "66" or "1" to "70", instead of "1" to "88". "D(k)" indicates the position (the state of contact between the damper 8 and the string 5) of the damper 8 corresponding to the key 2 indicated by "k", and "ON" indicates "releasing position", and "OFF" indicates "damping position".

Subsequently, the frequency distribution of an audio signal acquired from the decoding unit 155 is measured (step S111). The frequency distribution measurement in this example is carried out by an FFT (Fast Fourier Transform) process. In this example, a window function with a window of several seconds (e.g., 3 seconds) is used. The interval of the FFT process may be determined according to the time required from step S113 to step S141, and is 0.1 seconds, for example. k=0 is set (initialized) (step S113), and 1 is added to k (step S121).

Subsequently, it is determined whether V(f(k)) is greater than Vth1 (step S123). "f(k)" corresponds to the oscillation frequency (fundamental frequency) of a sound produced when the key 2 of "k" is operated. For example, when k is a value indicating the key 2 having a pitch corresponding to "A4", f(k)=440 Hz. "V(f(k))" indicates a level in the spectrum frequency f(k) determined by the frequency distribution measurement. "Vth1" is a predetermined level (may be different or the same for each "k"), and indicates a value serving as a criterion for determining whether to move the damper 8 from the damping position to the releasing position. If V(f(k)) is greater than Vth1 (step S123; Yes), D(k)=ON is set (step S125), and the procedure proceeds to step S131. On the other hand, if V(f(k)) is less than or equal to Vth1 (step S123; No), it is determined whether V(f(k)) is smaller than Vth2 (step S127). "Vth2" is a predetermined level (may be different or the same for each "k"), and indicates a value serving as a criterion for determining whether to move the damper 8 from the releasing position to the damping position. "Vth2" is smaller than "Vth1", but may be the same as "Vth1". If V(f(k)) is smaller than Vth2 (step S127; Yes), D(k)=OFF is set (step S129), and the procedure proceeds to step S131. On the other hand, if V(f(k)) is greater than or equal to Vth2 (step S123; No), the procedure directly proceeds to step S131.

If k=88 is not satisfied (step S131; No), the procedure returns to step S121. If k=88 is satisfied (step S131; Yes), the positions of the dampers 8 respectively corresponding to all of the keys 2 have been determined. Accordingly, the damper operation mechanisms 80 are driven to move the dampers 8 respectively corresponding to the keys 2 to the positions in accordance with D(k) (D(1) to D(88)), thus controlling the state of contact of the dampers 8 (step S141). Then, the procedure returns to the frequency distribution measurement (step S111).

With this damper control process, for example, when an audio signal contains many frequency components for high pitches C4, E4, and G4 (level higher than Vth1), the dampers 8 respectively corresponding to the keys 2 of C4, E4, and G4 are controlled to move to the releasing position. The audio signal is applied to the soundboard 7 by the vibrator 50, and is also transmitted to the strings 5. At this time, by releasing a particular string 5 corresponding to a pitch from the damper 8 as described above, the string 5 becomes more easily resonated owing to the relationship between the frequency distribution of the audio signal and the oscillation frequency of the string 5. Accordingly, a richer sound can be achieved by sympathetic resonance between the string 5 and the soundboard 7. On the other hand, if this level is lower than Vth2, the damper 8 is controlled to move to the damping position. This can also suppress excess resonance. Note that if the above-described amount of delay in the delay unit 156 is determined so as to reflect the size of the window function and the time required for the damper control process, the timing at which the damper 8 is controlled and the timing at which the soundboard 7 is vibrated can be synchronized, so that the releasing of the string 5 from the damper 8 can be performed more effectively.

In the case of the key driving setting, the key 2 is driven in order to push the damper operation mechanism 80 upward. Since the striking of the string is prevented by the stopper 40, the sound production by the vibration of the string 5 and the soundboard 7 and the operation of the key 2 look as if they have a correlation, thus making it possible to also provide a visual pleasure.

(4) Electronic Sound Listening Mode

Figure 12:
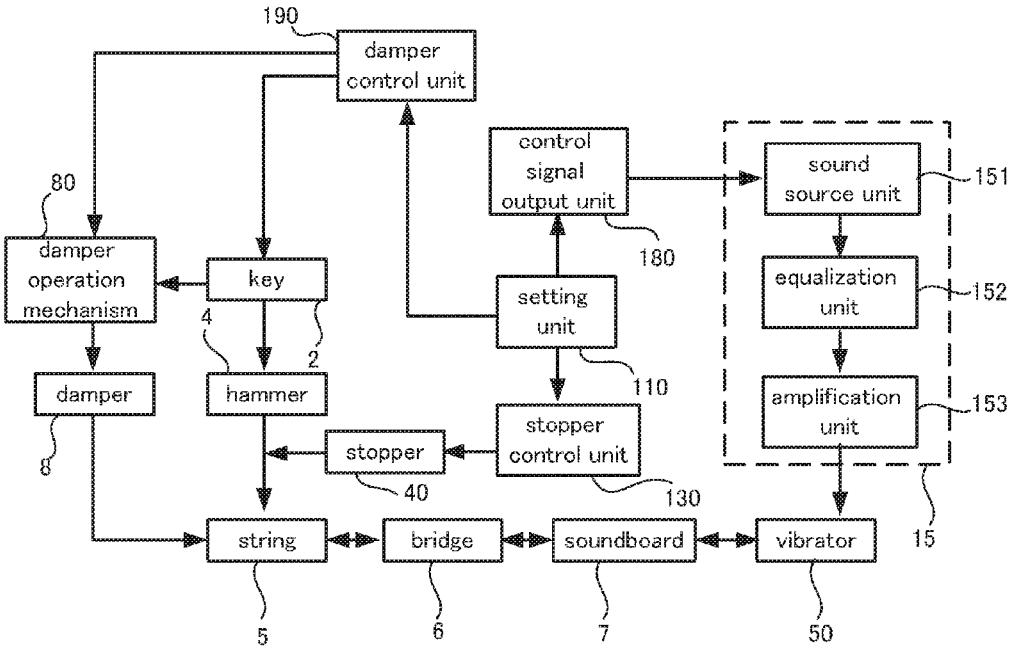
FIG. 12 is a block diagram showing a functional configuration of the grand piano when an electronic sound listening mode is set, according to the first embodiment of the present invention.

FIG. 12 is a block diagram showing a functional configuration of the grand piano when an electronic sound listening mode is set, according to the first embodiment of the present invention. This description is focused on differences from the above-described automatic performance mode. The setting unit 110 sets a music piece that is to be listened to. The setting information includes the information indicating the setting that has been applied, from among the damper stationary setting, the damper driving setting and the key driving setting, to the electronic sound listening mode on the basis of a user instruction.

The stopper control unit 130 moves the stopper 40 to the stopping position when the key driving setting is applied. The control signal output unit 180 is implemented as a component having the following function by means of the controller 11. When any of the damper stationary setting, the damper driving setting, and the key driving setting is applied, the control signal output unit 180 generates performance information on the basis of the performance control data corresponding to the music piece that has been set by the setting unit 110, and outputs the performance information to the sound source unit 151. Thus, the sound source unit 151 generates an audio signal corresponding to the performance information, as in the case of the automatic performance mode. The control signal output unit 180 also outputs the performance information to the damper control unit 190.

The damper control unit 190 is implemented as a component having the following function by means of the key drive device 30, the damper drive device 38, and the controller 11. When the damper stationary setting is applied, the damper control unit 190 holds all of the dampers 8 in a state where they have been moved to the damping position, without controlling the damper operation mechanism 80. On the other hand, in the key driving setting and the damper driving setting, the damper control unit 190 controls the damper operation mechanism 80 so as to change the state of contact between the damper 8 and the string 5, on the basis of the pitch information such as a key number and the period information among the output performance information. When the key driving setting is applied, the damper control unit 190 brings the key 2 into a depressed state by driving the key drive device 30 in accordance with the key control signal, thereby pushing the damper operation mechanism 80 upward so as to move a particular damper 8. On the other hand, when the damper driving setting is applied, the damper control unit 190 drives the damper drive device 38 in accordance with the damper control signal, thereby pushing the damper operation mechanism 80 upward so as to move a particular damper 8.

With this damper control process, for example, when the pitch information indicated by the performance information is "C4", the damper 8 corresponding to the key 2 of C4 is controlled to move to the releasing position for a time period indicated by the period information corresponding to the pitch information. The audio signal generated on the basis of this performance information is applied to the soundboard 7 by the vibrator 50, and is also transmitted to the string 5. At this time, by releasing a particular string 5 from the damper 8 on the basis of the pitch information as described above, the string 5 becomes more easily resonated owing to the relationship between the frequency distribution of the audio signal and the oscillation frequency of the string 5. Accordingly, a richer sound can be achieved by sympathetic resonance between the string 5 and the soundboard 7. When the time period indicated by the period information ends, the damper 8 is controlled to move to the damping position. This can also suppress excess resonance.

Second Embodiment

In the second embodiment, an example in which an upright piano 1B is used as an exemplary keyboard instrument will be described.

Figure 13:
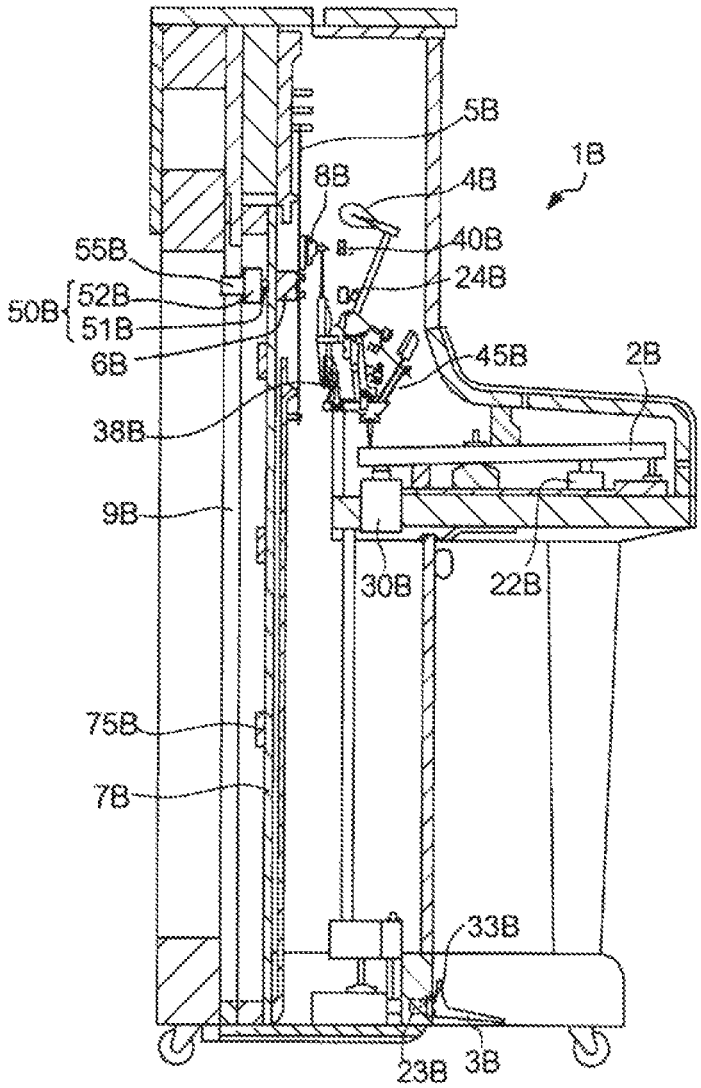
FIG. 13 is a diagram showing an internal structure of an upright piano according to a second embodiment of the present invention.
Figure 14:
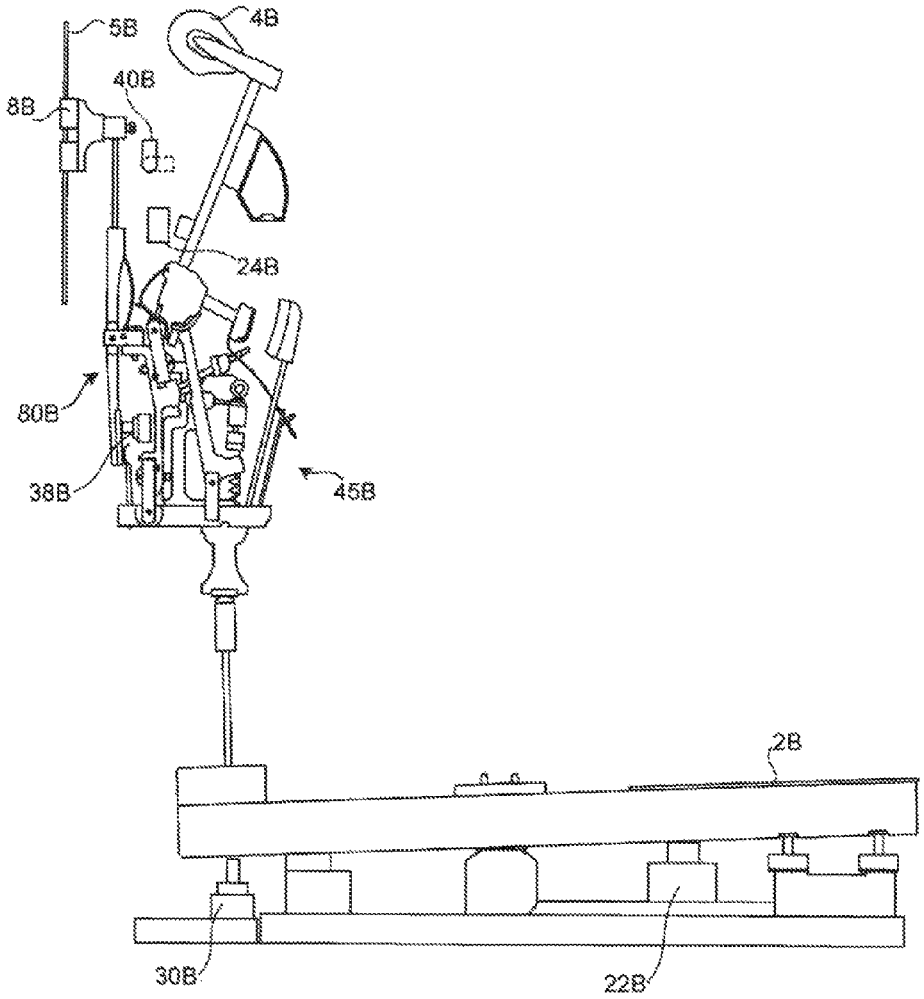
FIG. 14 is an enlarged view of the vicinity of an action mechanism of the upright piano according to the second embodiment of the present invention.

FIG. 13 is a diagram showing an internal structure of an upright piano according to a second embodiment of the present invention. FIG. 14 is an enlarged view of the vicinity of an action mechanism of the upright piano according to the second embodiment of the present invention. In FIG. 14, the components of the upright piano 1B are denoted by reference numerals to which the suffix "B" is added to the respective corresponding components of the grand piano 1 of the embodiment. Although components such as an action mechanism 45B and a damper operation mechanism 80B are different from the components of the grand piano 1 according to the first embodiment, the second embodiment is the same as the first embodiment in that a damper drive device 38B provided so as to correspond to the damper operation mechanism 80B moves the damper operation mechanism 80B so as to move a damper 8B within a range from the damping position to the releasing position.

Figure 15:
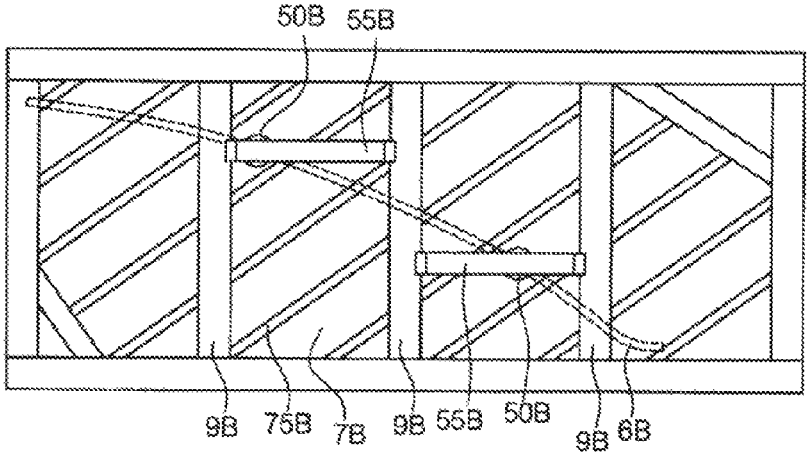
FIG. 15 is a diagram illustrating the position of a vibrator according to the second embodiment of the present invention.

FIG. 15 is a diagram illustrating the position of a vibrator according to the second embodiment of the present invention. In the case of the upright piano 1B as well, a vibration portion 51B of a vibrator 50B is connected to a soundboard 7B, and a yoke holding portion 52B is supported by a support portion 55B connected to vertical struts 9B. The vibrator 50B is connected between soundboard ribs 75B of the soundboard 7B. In addition, the vibrator 50B is provided at a position corresponding to a bridge 6B (i.e., the back surface of the soundboard 7B at a position at which the bridge 6B is attached). Although the support portion 55B is connected to a plurality of vertical struts 9B in the example shown in FIG. 15, the support portion 55B may be connected to one vertical strut 9B. Although the position at which the vibrator 50B is provided is the position corresponding to a long bridge of the bridges 6B, the position may be a position corresponding to a short bridge (not shown). Alternatively, the vibrator 50B may be provided at positions respectively corresponding to the long bridge and the short bridge.

Another Example of Position Control Process for Dampers

Although the method shown in FIG. 11 has been described as an example of the position control process for dampers, various other methods may be adopted. Some of these methods will be described below.

(1) Each time the FFT process is executed, the position of the damper 8 may be controlled on the basis of the resulting spectrum. For example, a predetermined number of peaks (e.g., 5 peaks) of the spectrum are detected in order from the highest level to the lowest level. Then, the string 5 with a pitch having the frequencies of the peaks as the fundamental frequency is identified, and the damper 8 corresponding to the string 5 may be controlled to move to the releasing position. At this time, a plurality of dampers 8 may be controlled to move to the releasing position for one pitch. For example, the damper 8 for a pitch with an octave difference from this pitch may be controlled to move to the releasing position.

(2) In (1), the frequency range may be divided into a plurality of segments (e.g., every octave), and the segments may be used to detect a high-level peak in each of the segments.

(3) In (1), if the positions of the peaks are concentrated in a predetermined frequency range, the pitches of some of those peaks do not need to be used, and the pitches of the peaks located away from the frequency range by a predetermined frequency or more may be used. In this case, it is desirable to use these peaks, starting from the peak that is located away toward the lower frequencies. At this time, instead of using the pitch of another peak, it is possible to use a pitch that is one octave lower than the pitch of the peak that is not used.

(4) In the example shown in FIG. 11, a plurality of "k" may be collectively processed. For example, "k" for pitches that are different by one octave may be collectively processed. Specifically, an iterative flow is executed for "k"=1 to 11, and k+12×a (a is an integer of 1 to 6: k+12, k+24, . . . k+72) may be handled as the same value.

(5) In the audio listening mode, the string 5 that vibrates at a frequency predominantly included in the audio signal is released from the damper 8. However, the string 5 that vibrates at a frequency that is not predominantly included in the audio signal may be released from the damper 8. That is, whether each of the dampers 8 is set to the releasing position or the damping position may be determined on the basis of the frequency distribution of the audio signal. This makes it possible to achieve various resonance effects. In the electronic sound listening mode as well, the damper 8 corresponding to the key 2 indicated by the pitch information does not necessarily need to be moved to the releasing position, and whether each of the dampers 8 is moved to the releasing position or the damping position may be determined on the basis of the pitch information.

(6) In the above-described embodiment, the damper 8 to be moved to the releasing position is determined by determining, as accurately as can be determined using FFT, the string 5 that can provide a resonance effect for a sound produced from the soundboard 7. The damper 8 may be determined by a determination method that can provide a certain degree of resonance effect. For example, a sound range including peaks with a predetermined value or more is determined in a sound based on the audio signal or the performance control data, the dampers 8 within the sound range may be driven on the basis of a predetermined rule (e.g., the damper 8 to be moved to the releasing position is randomly determined within a sound range in which the strings 5 are released from the dampers 8).

(7) In the audio listening mode, the string 5 that vibrates at a frequency predominantly included in the audio signal is released from the damper 8. However, the damper 8 to be moved to the releasing position may be determined on the basis of the intensity of a sound produced by driving the soundboard 7. That is, for example, a sound produced from the soundboard 7 on the basis of the audio signal may be collected with sound collection means such as a microphone, and using the sound pressure of the collected sound, whether each of the dampers 8 is moved to the releasing position or the damping position may be determined on the basis of a predetermined rule (e.g., the intensity of the sound pressure).

Modifications

Although embodiments of the present invention have been described above, the present invention may be implemented in various embodiments as described below.

In the above embodiments, a case where the present invention is applied as a keyboard instrument has been described. On the other hand, the keys 2 do not need to be used in the cases where the operation mode is the audio listening mode and the electronic sound listening mode, and the settings other than the key driving setting are applied. Accordingly, the present invention can be conceptualized as a sound producing apparatus that does not include the keys 2.

In the cases where the operation mode is the audio listening mode and the electronic sound listening mode, the strings 5 may be released from all the dampers 8 by driving the pedal 3 or by driving the damper drive devices 38, if a predetermined condition is satisfied. For example, in the case of the audio listening mode, the damper 8 may be moved to the releasing position if the output level of the audio signal has reached a predetermined value or more. In the case of the electronic sound listening mode, the control may be performed similarly on the basis of the output level of the audio signal. Alternatively, when the performance information of the damper pedal among the performance control data is present, the control may be performed in accordance with the performance information.

In the above-described embodiments, the same drive signal is input to the plurality of vibrators 50. However, a different drive signal may be input for each vibrator 50. For example, the sound source unit 151 may output audio signals so as to respectively correspond to the vibrators 50, and the frequency distribution adjustment in the equalization unit 152 and the amplification in the amplification unit 153 may be performed separately for each of the audio signals. By doing so, the adjustment form of the frequency distribution and the setting of the parameters of the amplification factor can be set as different parameters for each vibrator 50.

A plurality of audio signals output from the sound source unit 151 may be signals different from each other. For example, in the case of using two vibrators 50, the audio signals corresponding to the vibrators 50 may be an L-ch audio signal and an R-ch audio signal, respectively, or may be audio signals indicating musical tones having tone colors different from each other. The audio signals may have frequency bands different from each other. In this case, an audio signal having a higher frequency band may be output to the vibrator 50H, and an audio signal having a lower frequency band may be output to the vibrator 50L.

REFERENCE SIGNS LIST

1 Grand piano
1B Upright piano
2, 2B Key
3, 3B Pedal
4, 4B Hammer
5, 5B String
6, 6B, 6H, 6L Bridge
7, 7B Soundboard
8, 8B Damper
9, 9B Vertical strut
10 Control device
11 Controller
12 Storage unit
13 Operation panel
14 Communication unit
15 Signal output unit
16 Interface
17 Bus
22, 22B Key sensor
23, 23B Pedal sensor
24, 24B Hammer sensor
30, 30B Key drive device
33, 33B Pedal drive device
38, 38B Damper drive device
39 Lifting rail
40, 40B Stopper
45, 45B Action mechanism
50, 50B, 50H, 50L Vibrator
51, 51B Vibration portion
511 Connection member
512 Voice coil
52, 52B Yoke holding portion
521, 523 Yoke
522 Magnet
524 Housing
53 Damper portion
55, 55B Support portion
60 Touch panel
75, 75B Soundboard rib
80, 80B Damper operation mechanism
110 Setting unit
120, 180 Control signal output unit
130 Stopper control unit
151 Sound source unit
152 Equalization unit
153 Amplification unit
155 Decoding unit
156 Delay unit
170 Data output unit
190 Damper control unit

The invention claimed is:

1. A sound producing apparatus comprising:
a plurality of sound producing members having oscillation frequencies different from each other;
dampers that are disposed so as to correspond to respective ones of the sound producing members and suppress vibration by coming into contact with the respective corresponding sound producing members;
a damper operation mechanism that moves each of the dampers, thereby controlling a state of contact of the damper with a corresponding one of the sound producing members;
a soundboard that undergoes sympathetic resonance with the sound producing members;
a vibrator that vibrates the soundboard;
an acquisition unit configured to acquire performance control data containing pitch information that specifies at least a pitch of a sound producing content;
a signal output unit configured to: generate an audio signal indicating the sound producing content, on the basis of the acquired performance control data; generate a drive signal for driving the vibrator in accordance with the sound producing content, on the basis of the generated audio signal; and output the drive signal to the vibrator; and
a damper control unit configured to drive the damper operation mechanism so as to change a state of contact between the sound producing members and the respective corresponding dampers, on the basis of the pitch specified by the acquired performance control data.

2. The sound producing apparatus according to claim 1,
wherein the performance control data contains period information that specifies sound producing periods of sounds of the sound producing content, and
the damper control unit is configured to drive the damper operation mechanism so as to change a state of contact between the sound producing members and the respective corresponding dampers, on the basis of the period information contained in the acquired performance control data.

3. A keyboard instrument comprising:
the sound producing apparatus according to claim 1;
keys disposed so as to correspond to respective ones of the sound producing members;
hammers that each strike, as a result of one of the keys being depressed, a corresponding one of the sound producing members corresponding to the key, thereby vibrating the sound producing member;
a stopper for stopping the hammers from striking the sound producing members; and
a stopper control unit configured to control a state of stopping the hammers by the stopper,
wherein the damper operation mechanism releases the sound producing member from the damper from as a result of the key being depressed, and
the damper control unit is configured to drive the key in a state where the stopper stops the hammer from striking the sound protruding member, thereby driving the damper operation mechanism via the key.

4. A keyboard instrument comprising:
the sound producing apparatus according to claim 1;
keys disposed so as to correspond to respective ones of the sound producing members; and hammers that each strike, as a result of one of the keys being depressed, the sound producing member corresponding to the key, thereby vibrating the sound producing member, wherein the damper operation mechanism releases the sound producing member from the damper as a result of the key being depressed, and the damper control unit is configured to drive the key so as to prevent the hammer from striking the sound producing member, thereby driving the damper operation mechanism via the key.

5. A sound producing apparatus comprising:

a plurality of sound producing members having oscillation frequencies different from each other;

dampers that are disposed so as to correspond to respective ones of the sound producing members and suppress vibration by coming into contact with the respective corresponding sound producing members;

a damper operation mechanism that moves each of the dampers, thereby controlling a state of contact of the damper with a corresponding one of the sound producing members;

a soundboard that undergoes sympathetic resonance with the sound producing members;

a vibrator that vibrates the soundboard;

an acquisition unit configured to acquire an audio signal;

a signal output unit configured to: generate a drive signal for driving the vibrator with a vibration corresponding to the acquired audio signal; and output the drive signal to the vibrator; and a damper control unit configured to drive the damper operation mechanism so as to change a state of contact between the sound producing members and the respective corresponding dampers, on the basis of a frequency distribution of the acquired audio signal.

6. The sound producing apparatus according to claim 5, wherein the signal output unit is configured to output the drive signal to the vibrator upon elapse of a predetermined time after the drive signal has been generated.

7. The sound producing apparatus according to claim 5, wherein the damper control unit is configured to, if the frequency distribution of the acquired audio signal satisfies a particular condition, drive the damper operation mechanism so as to change a state of contact between the sound producing members and the respective corresponding dampers.

8. The sound producing apparatus according to claim 5, wherein the damper control unit is configured to drive the damper operation mechanism so as to change a state of contact between the sound producing members and the respective corresponding dampers with a predetermined period.

9. A keyboard instrument comprising:

the sound producing apparatus according to claim 5;

keys disposed so as to correspond to respective ones of the sound producing members;

hammers that each strike, as a result of one of the keys being depressed, a corresponding one of the sound producing members corresponding to the key, thereby vibrating the sound producing member;

a stopper for stopping the hammers from striking the sound producing members; and a stopper control unit configured to control a state of stopping the hammers by the stopper, wherein the damper operation mechanism releases the sound producing member from the damper from as a result of the key being depressed, and the damper control unit is configured to drive the key in a state where the stopper stops the hammer from striking the sound protruding member, thereby driving the damper operation mechanism via the key.

10. A keyboard instrument comprising:

the sound producing apparatus according to claim 5;

keys disposed so as to correspond to respective ones of the sound producing members; and hammers that each strike, as a result of one of the keys being depressed, the sound producing member corresponding to the key, thereby vibrating the sound producing member, wherein the damper operation mechanism releases the sound producing member from the damper as a result of the key being depressed, and the damper control unit is configured to drive the key so as to prevent the hammer from striking the sound producing member, thereby driving the damper operation mechanism via the key.

11. A sound producing apparatus comprising:

a plurality of sound producing members having oscillation frequencies different from each other;

dampers that are disposed so as to correspond to respective ones of the sound producing members and suppress vibration by coming into contact with the respective corresponding sound producing members;

a damper operation mechanism that moves each of the dampers, thereby controlling a state of contact of the damper with a corresponding one of the sound producing members;

a soundboard that undergoes sympathetic resonance with the sound producing members;

a vibrator that vibrates the soundboard;

an acquisition unit configured to acquire an audio signal;

a signal output unit configured to: generate a drive signal for driving the vibrator with a vibration corresponding to the acquired audio signal; and output the drive signal to the vibrator; and a damper control unit configured to drive the damper operation mechanism so as to change a state of contact between the sound producing members and the respective corresponding dampers, on the basis of a sound intensity of the acquired audio signal.

12. A keyboard instrument comprising:

the sound producing apparatus according to claim 11;

keys disposed so as to correspond to respective ones of the sound producing members;

hammers that each strike, as a result of one of the keys being depressed, a corresponding one of the sound producing members corresponding to the key, thereby vibrating the sound producing member;

a stopper for stopping the hammers from striking the sound producing members; and a stopper control unit configured to control a state of stopping the hammers by the stopper, wherein the damper operation mechanism releases the sound producing member from the damper from as a result of the key being depressed, and the damper control unit is configured to drive the key in a state where the stopper stops the hammer from striking the sound protruding member, thereby driving the damper operation mechanism via the key.

13. A keyboard instrument comprising:

the sound producing apparatus according to claim 11;

keys disposed so as to correspond to respective ones of the sound producing members; and hammers that each strike, as a result of one of the keys being depressed, the sound producing member corresponding to the key, thereby vibrating the sound producing member, wherein the damper operation mechanism releases the sound producing member from the damper as a result of the key being depressed, and the damper control unit is configured to drive the key so as to prevent the hammer from striking the sound producing member, thereby driving the damper operation mechanism via the key.

14. A sound production control method for use in a sound producing apparatus including: a plurality of sound producing members having oscillation frequencies different from each other; dampers that are disposed so as to correspond to respective ones of the sound producing members and suppress vibration by coming into contact with the respective corresponding sound producing members; a damper operation mechanism that moves each of the dampers, thereby controlling a state of contact of the damper with a corresponding one of the sound producing members; a soundboard that undergoes sympathetic resonance with the sound producing members; and a vibrator that vibrates the soundboard, the method comprising the steps of:

acquiring performance control data containing pitch information that specifies at least a pitch of a sound producing content;

generating an audio signal indicating the sound producing content on the basis of the performance control data, and driving the vibrator in accordance with the sound producing content on the basis of the generated audio signal; and driving the damper operation mechanism so as to change a state of contact between the sound producing members and the respective corresponding dampers on the basis of the pitch specified by the performance control data.

15. A sound production control method for use in a sound producing apparatus including: a plurality of sound producing members having oscillation frequencies different from each other; dampers that are disposed so as to correspond to respective ones of the sound producing members and suppress vibration by coming into contact with the respective corresponding sound producing members; a damper operation mechanism that moves each of the dampers, thereby controlling a state of contact of the damper with a corresponding one of the sound producing members; a soundboard that undergoes sympathetic resonance with the sound producing members; and a vibrator that vibrates the soundboard, the method comprising the steps of:

acquiring an audio signal;

driving the vibrator with a vibration corresponding to the audio signal; and driving the damper operation mechanism so as to change a state of contact between the sound producing members and the respective corresponding dampers, on the basis of a frequency distribution of the audio signal.

16. A sound production control method for use in a sound producing apparatus including: a plurality of sound producing members having oscillation frequencies different from each other; dampers that are disposed so as to correspond to respective ones of the sound producing members and suppress vibration by coming into contact with the respective corresponding sound producing members; a damper operation mechanism that moves each of the dampers, thereby controlling a state of contact of the damper with a corresponding one of the sound producing members; a soundboard that undergoes sympathetic resonance with the sound producing members; and a vibrator that vibrates the soundboard, the method comprising the steps of:

acquiring an audio signal;

driving the vibrator with a vibration corresponding to the audio signal; and driving the damper operation mechanism so as to change a state of contact between the sound producing members and the respective corresponding dampers, on the basis of a sound intensity of the audio signal.

* * * * *